US006776307B1

(12) United States Patent
Hagihara

(10) Patent No.: US 6,776,307 B1
(45) Date of Patent: Aug. 17, 2004

(54) NOZZLE OF FLUID CONTAINER AND FLUID CONTAINER HAVING THE NOZZLE

(76) Inventor: Tadashi Hagihara, 606 Dai2Skyheights, 120 Saiwai-cho, Nishimabashi, Matsudo-shi Chiba 271 (JP)

( * ) Notice: Subject to any disclaimer, the term of this patent is extended or adjusted under 35 U.S.C. 154(b) by 0 days.

(21) Appl. No.: 09/959,924

(22) PCT Filed: Mar. 31, 2000

(86) PCT No.: PCT/JP00/02135

§ 371 (c)(1),
(2), (4) Date: Nov. 13, 2001

(87) PCT Pub. No.: WO00/68105

PCT Pub. Date: Nov. 16, 2000

(30) Foreign Application Priority Data

| | | |
|---|---|---|
| May 10, 1999 | (JP) | 11/127992 |
| Jun. 9, 1999 | (JP) | 11/163026 |
| Nov. 1, 1999 | (JP) | 11/311360 |
| Feb. 8, 2000 | (JP) | 2000/30030 |

(51) Int. Cl.[7] ..... B65D 37/00
(52) U.S. Cl. ..... 222/107; 222/92; 222/494
(58) Field of Search ..... 222/92, 107, 212, 222/206, 213, 215, 491, 494

(56) References Cited

U.S. PATENT DOCUMENTS

| | | | | | |
|---|---|---|---|---|---|
| 3,815,794 | A | * | 6/1974 | Carlisle | 222/491 |
| 4,252,257 | A | * | 2/1981 | Herzig | 222/213 |
| 5,373,965 | A | * | 12/1994 | Halm et al. | 222/92 |
| 5,411,178 | A | * | 5/1995 | Roders et al. | 222/105 |
| 5,772,651 | A | * | 6/1998 | De Haen et al. | 604/403 |

FOREIGN PATENT DOCUMENTS

| | | | | |
|---|---|---|---|---|
| JP | 56-46550 | | 4/1981 | |
| JP | 58-154143 | | 10/1983 | |
| JP | 62-130048 | | 8/1987 | |
| JP | 64-35849 | | 3/1989 | |
| JP | 7-22950 | | 4/1995 | |
| JP | 3027461 | | 5/1996 | |
| JP | 8-282681 | | 10/1996 | |
| JP | 10-338248 | | 12/1998 | |
| JP | 11-20837 | | 1/1999 | |
| WO | WO 99/03391 | * | 1/1999 | A47K/5/12 |

OTHER PUBLICATIONS

Machine translation of JP A 11–20837, Hiroshi et al., Jan. 26, 1999.*

Microfilm of the specification and drawings annexed to the request of Japanese Utility Model Application No. 189240/1986 (Laid–open No. 130048/1987) (Peter Tompson) Aug. 17, 1987, p. 13, lines 11–18, Figures 1–4.

CD–ROM of the specification and drawings annexed to the request of Japanese Utility Model Application No. 59641/1993 (Laid–open No. 22950/1995) (Kabushiki Kaisha Daiwa Packs) Apr. 25, 1995, Par. No. [0006]; Figs. 1–5.

Microfilm of the specification and drawings annexed to the request of Japanese Utility Model Application No. 128993/1979 (Laid–open No. 465501/1981) (Kinichi Kimura) Apr. 25, 1981, p. 6, line 11 to p. 7, line 1; Fig. 1.

* cited by examiner

*Primary Examiner*—Paul J. Hirsch
*Assistant Examiner*—Patrick Buechner
(74) *Attorney, Agent, or Firm*—Wenderoth, Lind & Ponack, L.L.P.

(57) ABSTRACT

A nozzle is attached to a tip of a fluid container which is formed of two flexible sheets overlapped with each other. The sheets have their internal surfaces fitted to each other in a normal state after contents are filled into the container such that even a very small portion of contents remaining in the container can be removed by a required amount without coming into contact with air.

13 Claims, 24 Drawing Sheets

NOZZLE OF FLUID CONTAINER AND FLUID CONTAINER HAVING THE NOZZLE

TECHNICAL FIELD

The present invention relates to a nozzle of a flexibile fluid container such as a tubular-like or a bag-like container adapted to discharge contents there from by pressing a body of the container, and also relates to a fluid container having the nozzle.

TECHNICAL BACKGROUND

Various products such as drinks, cosmetics or adhesives which are packed in tubes or bag-like containers, irrespective of their natures or applications, have been commercially widespread.

Features which are common to these products packed in a flexible container are that these products are generally a gel-like fluid, and these products are incompatible with air upon making contact therewith (anaerobic). That is, should the products make contact with the air, they would be oxidized, deteriorated or hardened.

Features of containers to be packed therein with such anaerobic fluid are such that air should be prevented from being drawn into a container by a quantity corresponding to a volume of the fluid which has been discharged from the container, and accordingly, a tube or a bag-like container which can be deformed itself, depending upon a remaining quantity of its contents, has preferably been used. A conventional container of this kind has been composed of a charging part made of a flexible material, and a nozzle part made of a hard material and coupled to the charging part.

Further, since a body of the container is flexible, if a force exerted to the body of the container is released therefrom after contents thereof are discharged therefrom, an interior pressure of the body of the container becomes slightly negative since this container is to restore to its original shape. Accordingly, there may be such a feature that contents thereof are drawn through a tip of the nozzle.

Accordingly, a cap of the nozzle is formed in its inner bottom part with a protrusion for making up for a space defined by contents drawn from the tip of the nozzle.

However, an anaerobic substance is oxidized at once over its surface so as to start deteriorating when it makes contact with air even for a short time and though it quantity is small. If the substance does not deteriorate at an inner portion thereof, although it does at its surface which makes contact with the air, the substance can be used a next time by removing such a deteriorated part therefrom. However, it is usual that deterioration progresses to an inner portion of the substance and propagates in its entirety within a container.

Further, with repetition of removal of a deteriorated part several times, a quantity of the substance to be discarded becomes considerable. If the substance is expensive, it causes a serious problem.

Thus, there has been such a demand that contents are allowed to make contact with air only by a required quantity, and further, the contents are extracted by the required quantity, and are prevented from making contact with the air.

Accordingly, the present invention is devised in order to solve the above-mentioned problems, and accordingly, an object of the present invention is to provide a nozzle for a fluid container, which allows contents of the container to be extracted by a required quantity, completely without making contact with air even though a small amount the contents remains in the container, and to provide a fluid container incorporating such a nozzle.

SUMMARY OF THE INVENTION

According to the present invention, there is provided a nozzle for a fluid container, characterized in that (1) the nozzle, provided at a front end of a fluid container, is composed of at least two flexible sheets which are superposed with each other, and which are designed such that their inner surfaces are close contact with one other in a normal state after contents are charged;

(2) the nozzle, provided at a front end of the fluid container, is composed of at least two flexible sheets which are superposed with each other, and which are designed such that their inner surfaces are in close contact with one other in a normal state after contents are charged, and further, close contact at an upstream side of the nozzle is released by contents being expelled toward the nozzle by an internal pressure of the container, but a degree of the close contact becomes higher at a leading end part of the contents since at least one of the flexible sheets constituting the nozzle is bent at this part, thereby inhibiting contents from flowing out of the nozzle;

(3) at least one of the flexible sheets constituting the nozzle is formed at a desired position thereof with a border line serving as a crease;

(4) a hardness of the flexible sheets constituting the nozzle is different between an upstream side and a downstream side of the crease;

(5) a thickness of the flexible sheets constituting the nozzle is different between the upstream side and the downstream side of the crease, (6) close contact portions of the sheets are curved in their normal state in a three-dimensionally curved surface-like manner;

(7) close contact portions of the sheets are rolled in their normal state;

(8) close contact parts of the sheets are bent in their normal state;

(9) of the flexible sheets, a curved sheet or a sheet on a bending direction side is further provided on its inner side with an elastic member for forcing this sheet to curve or bend, and the flexible sheets constituting the nozzle are extended along rear surfaces of the elastic member so as to be in close contact therewith by an elastic force of the elastic member;

(10) the flexible sheets constituting the nozzle are superposed with each other so as to be formed into a dish-like shape;

(11) at a welded part of the nozzle defining therein a fluid passage, widthwise of the nozzle, a width of the welded part of the nozzle is larger by a desired length on an upstream side of the nozzle than on a downstream side of the nozzle;

(12) at a welded part of the nozzle defining therein a fluid passage, widthwise of the nozzle, after a first welding, welding is again performed by a clamping force higher than that of the first welding;

(13) a tubular part is formed of a desired length at an upstream part of the nozzle;

(14) an upstream part and a downstream part of the nozzle are made respectively of different materials, and are integrally joined with each other on one and the same axis;

(15) a manner of joining an upstream part and downstream part of the nozzle is by performing a thermal welding process;

(16) an inner surface of an upstream tubular part of the nozzle is subjected to a non-thermal welding process; and

(17) two passages are formed.

Further, the fluid container according to the present invention is characterized by:

(1) in a fluid container composed of a nozzle part and a container body part which are integrally incorporated with each other, the nozzle part being formed from at least two flexible sheets which are superposed with each other and are welded to each other along their peripheries, and the nozzle part being characterized by either of the above-mentioned items (1) or (2);

(2) in a fluid container which is formed by flattening a tubular body made of flexible sheets of material, and then by welding and cutting a periphery thereof into a contour shape of the container, a nozzle part being characterized by any one of the above-mentioned items (1) to (12);

(3) a nozzle being removably attached to the fluid container or being integrally incorporated with the fluid container, stated in any one of the above-mentioned items (1) to (17);

(4) the fluid container body being tubular;

(5) the fluid container being a gusset bag;

(6) a member for preventing the flexible sheets from coming into close contact with each other being provided between the nozzle part and the fluid container part; and (7) filler port being provided, in addition to the nozzle.

DETAILED DESCRIPTION OF THE PREFERRED EMBODIMENTS

Figure 1A:
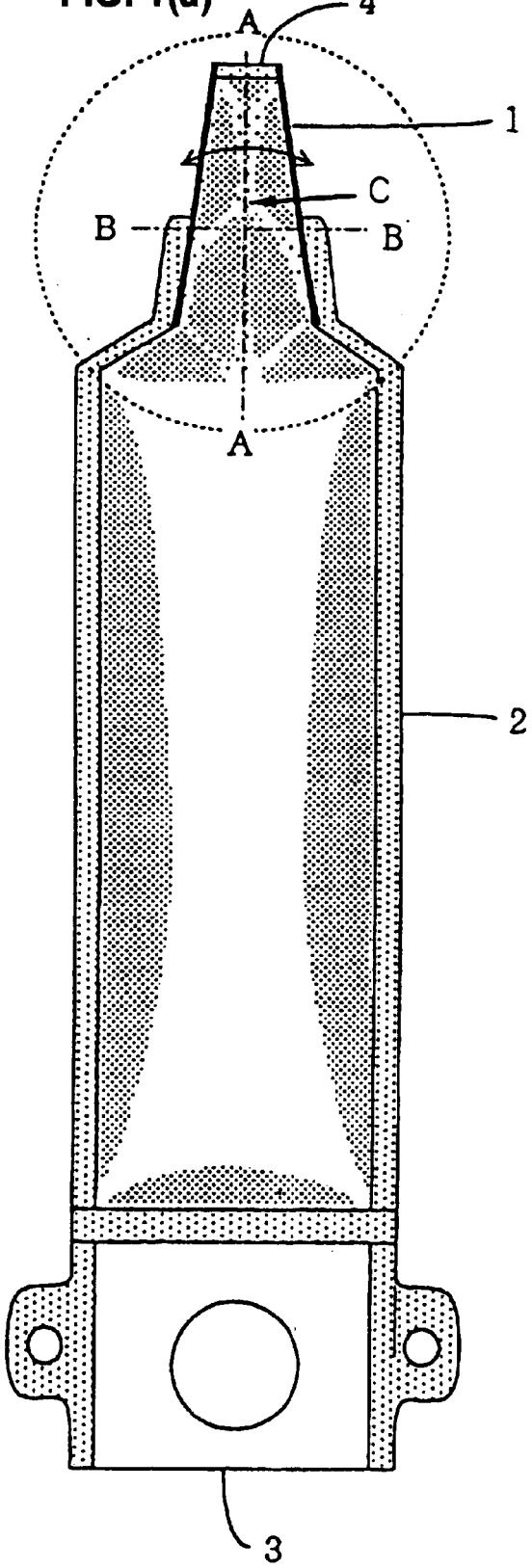
FIG. 1(*a*) and FIG. 1(*b*) are a front view and a side view, respectively, illustrating a first embodiment of the present invention.
Figure 1B:
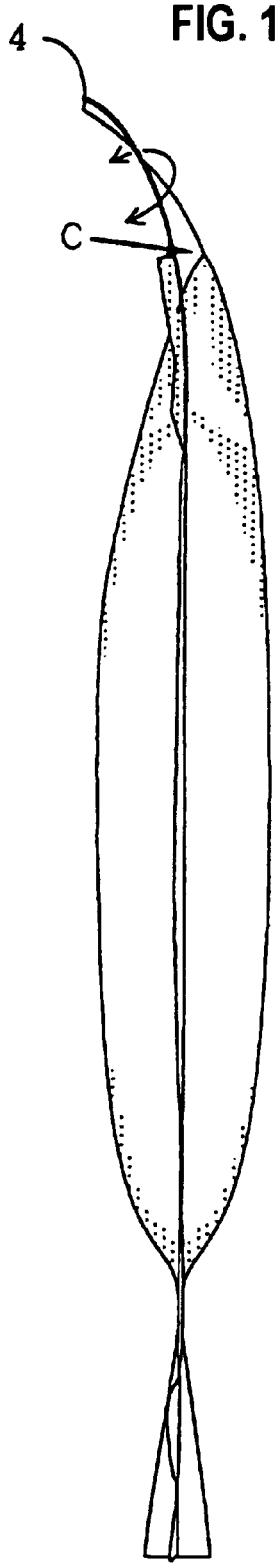

Explanation will be hereinbelow made of embodiments of the present invention with reference to the accompanying drawings:

FIGS. 1(*a*) and 1(*b*) show a first embodiment of a nozzle for a fluid container, according to the present invention, among which FIG. 1(*a*) is a front view and FIG. 1(*b*) is a side view.

Referring to the figures, there are shown a nozzle or nozzle body 1, a container or container body 2 and a filling port 3, with liquid contents being filled therein. Arrows shown in these figures indicate that the nozzle body 1 has a curved surface shape, that is, a spoon-like shape.

Figure 2A:
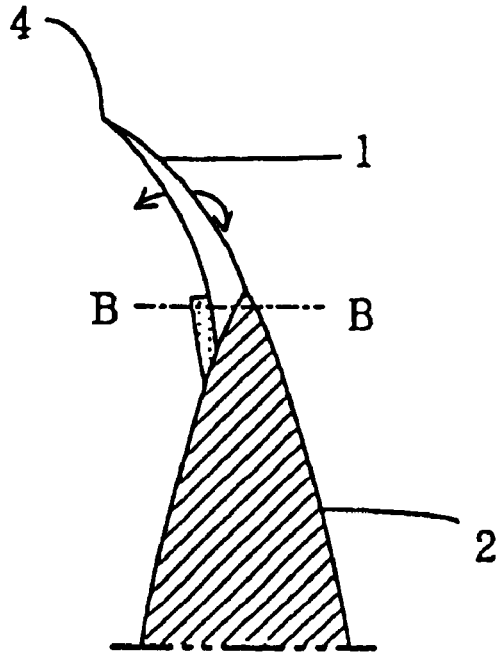
FIG. 2(*a*) and FIG. 2(*b*) are a sectional views illustrating an essential part of the first embodiment.
Figure 2B:
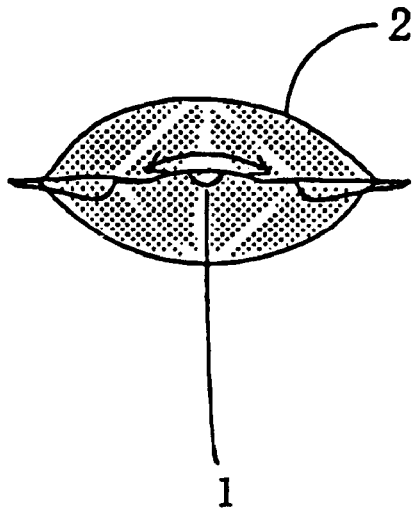
Figure 3A:
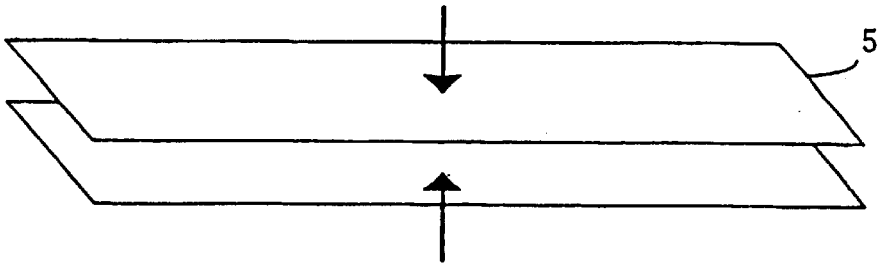
FIGS. 3(*a*)–3(*d*) are views for explaining a method of forming a nozzle and a container body.
Figure 3B:
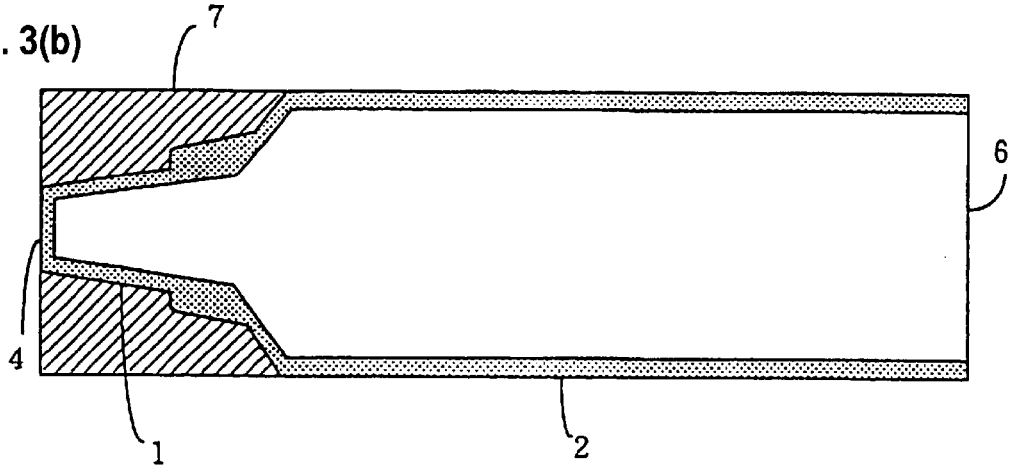
Figure 3C:
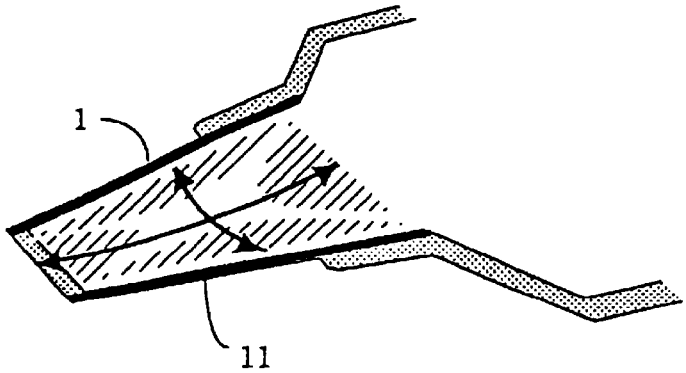
Figure 3D:
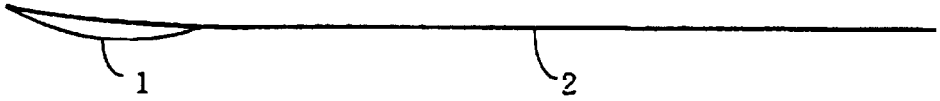

FIGS. 2(*a*) and 2*b* are sectional views illustrating an essential part within a dotted line shown in FIG. 1, among which FIG. 2(*a*) is a sectional view along line A—A, and FIG. 2(*b*) is a sectional view along line B—B. The container explained in this embodiment is a bag-like container, and is formed of two flexible sheets which are welded to each other at their outer peripheries, as will be detailed later. The nozzle body 1 of this fluid container has a right side surface which is depicted by a continuous line from the container body 2 to a nozzle tip end 4 as shown in FIG. 1(*b*), while the nozzle body has a left side which is curved in a part indicated by arrow C. With this curve, two flexible sheets constituting the nozzle body 1 are made to be in close contact with each other so as to block contents in the container body 2 in order to prevent the contents from flowing out.

The fluid container in this embodiment is formed from, for example, a method as shown in FIGS. 3(*a*) to 3(*d*):

At first, (a) two flexible sheets 5 having a desired shape (rectangular shape) are superposed with each other, and (b) are welded at their peripheries, except a filling opening part 6. During this stage, a shaded part 7 may be cut off, simultaneously with the welding. A nozzle tip end 4 is welded but a rear end 6 of the container body is opened in order to define a filling port 3 in the opening part 6. The filling port 3 shown in FIG. 1(*a*) is a filling port which is formed separately and is then welded. After filling of the container, the opening part (rear end of the container body) 6 is welded closed.

The nozzle body 1 is curved vertically and horizontally, as shown in FIG. 1(*b*), and has a curved surface-like shape, that is, spoon-like shape as a whole. FIG. 3(*d*) is a side view which shows a condition in which no contents are filled into the container body.

It is desirable to weld the nozzle tip end 4 closed when contents are foodstuffs, particularly in view of a sanitary reason. However, after contents are filled, because the nozzle body 1 is curved, a degree of adhesion is increased between the flexible sheets of the nozzle body 1 so that it is difficult for the contents to leak, whereby welding is not always necessary.

Figure 4A:
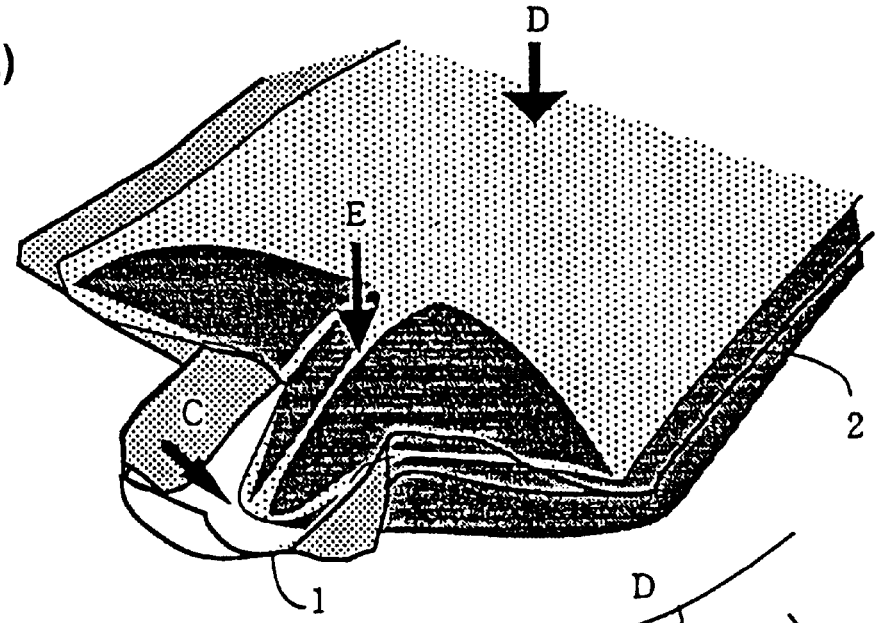
FIGS. 4(*a*)–4(*c*) are views for explaining operation of the nozzle of the present invention.
Figure 4B:
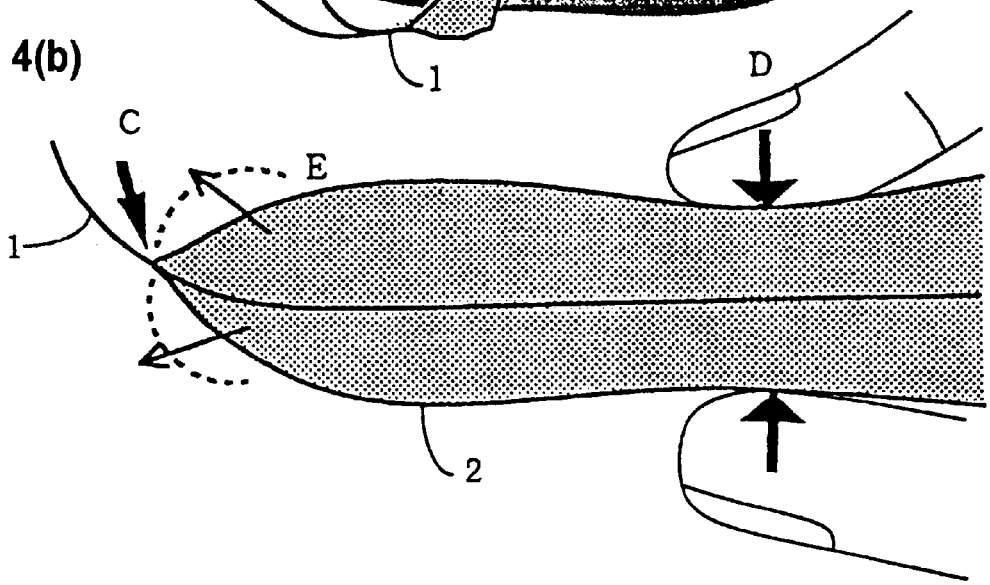
Figure 4C:
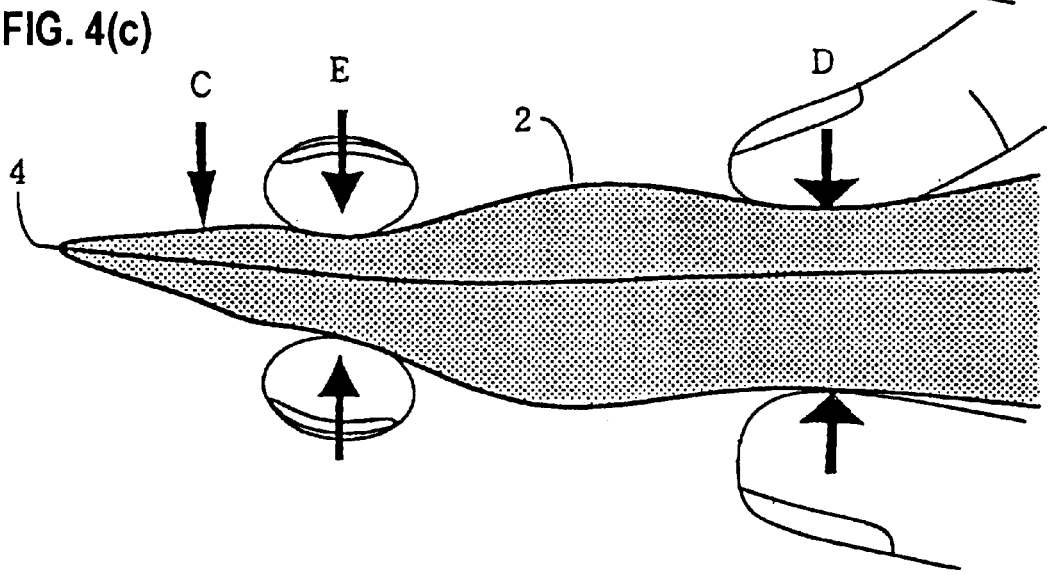

FIGS. 4(*a*) to 4(*c*) show the operation of the nozzle body 1 of this fluid container.

In these figures, FIG. 4(*a*) is a perspective view illustrating a condition in which contents are filled into the container body, and FIGS. 4(*b*) and 4(*c*) are longitudinal sectional views of the nozzle body.

In a normal state, when the container body 2 is pressed by a finger or the like (point D) so as to increase internal pressure, contents in the container body 2 are pushed toward the nozzle 1. Although the nozzle 1 had been curved or bent (i.e. made non-planar) at point C at a time of filling contents into the container body, as shown in FIG. 4(*b*), a part E shown in this figure bulges out due to internal pressure of the container, and as a result, the nozzle is further curved or bent at point C. Thus, the two flexible sheets constituting the nozzle 1 tightly adhere to each other, and are further curved or bent in order to hold such a condition that a passage between the two flexible sheets is automatically blocked, whereby it is possible to prevent contents from flowing out of the nozzle.

At this time, by depressing the part E shown in the figures with a finger or the like, curvature or bending of the nozzle 1 at point C is decreased, and accordingly, the passage is ensured so that contents flow into the nozzle tip end 4.

A principle utilized by the present invention will be explained as follows:

The above-mentioned operation will be explained in detail with reference to FIGS. 5(*a*) to 5(*c*).

The container body 2 is planar when it is empty, and after contents are filled therein, the container body is formed into a substantially tubular shape. When part D of the container body is pressed so as to increase internal pressure thereof, the container itself is deformed into a cylindrical shape, and then into a spherical shape. Accordingly, the nozzle 1 which has already been curved or bent at point C is increased with regard to its curvature or bending at point C.

The nozzle of the fluid container according to the present invention, is one for which a cap is not necessary.

Next, explanation will be made of a method of using the container incorporating the nozzle according to the present invention.

Figure 6A:
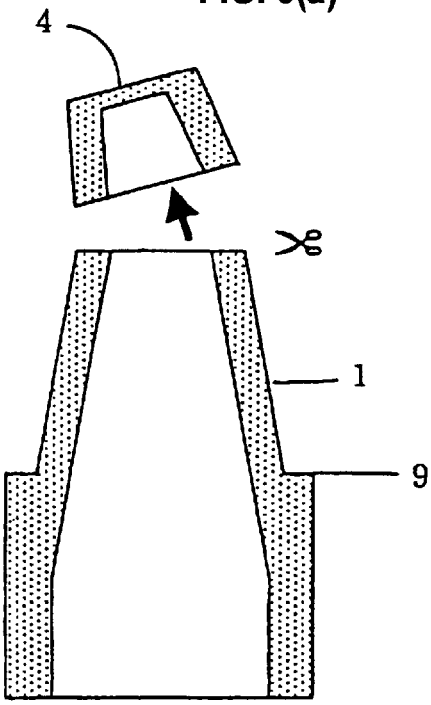
FIGS. 6(*a*) and 6(*b*) are views for explaining a method of using the nozzle of the present invention.
Figure 6B:
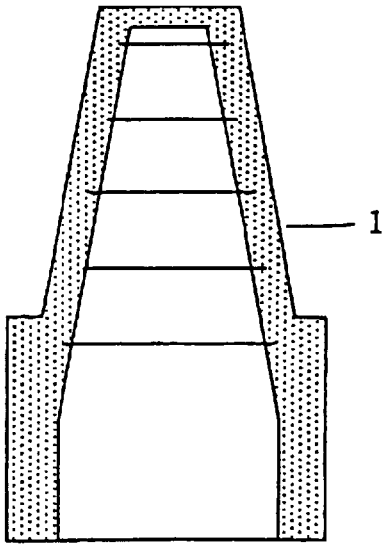

As shown in FIG. 6(*a*), the nozzle tip end 4 is at first cut, and as shown in FIG. 6(*b*), a fluid passage in the nozzle 1 is taper-like, being blocked at a forward portion, and accordingly, a cutting position is changed in order to obtain an opening area, depending upon a required discharge rate.

Figure 7:
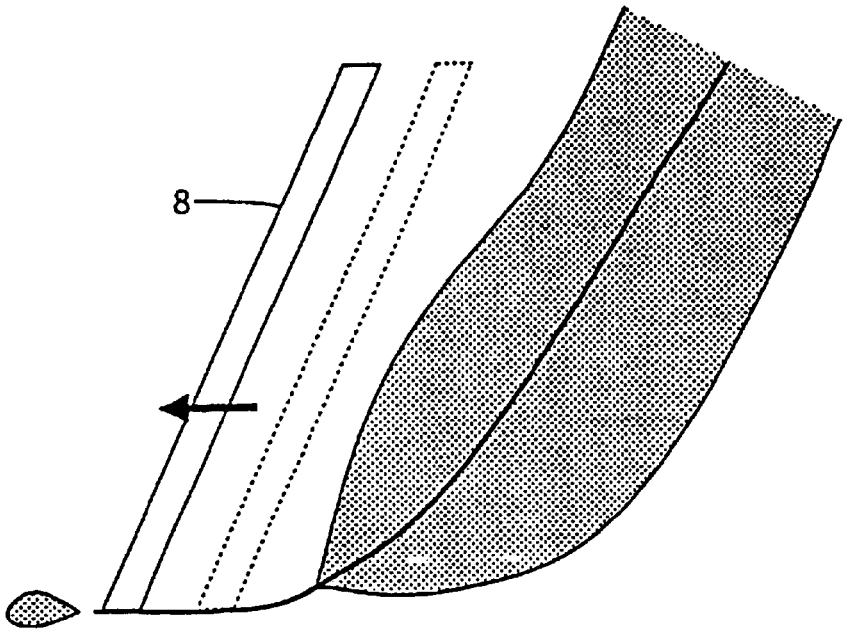
FIG. 7 is a view for explaining a method of using the nozzle of the present invention.

In order to discharge contents, at first, as shown in FIG. 4(*b*), the container body 2 is depressed by a finger or the like so as to increase internal pressure of the container body. When joint base part E of the nozzle 1 is depressed by another finger, thicknesswise of the container, contents stretch a curve or bend of the nozzle at point C, and accordingly, the contents force the passage to open by itself while the contents are pushed toward the nozzle tip end 4. After contents are discharged by a substantially required quantity, contents in the nozzle 1 are squeezed out by a finger, a spatula 8 as shown in FIG. 7, or the like.

Contents in the nozzle 1 may be, of course, pushed back into the container body 2 without a volume of these contents being discharged in its entirety.

As mentioned above, by expelling residual contents from the nozzle 1, the sheets come into close contact with each other so as to effect sealing, and accordingly, no air flows into the nozzle. Thus, contents remaining in the container body 2 are completely prevented from making contact with air, whereby it is possible to prevent the contents from being deteriorated, that is, being oxidized or discolored.

Only for this reason, since contents in the nozzle 1 can be thoroughly discharged so that the two flexible sheets 5 constituting the nozzle 1 make contact with each other, no contents are discharged while no ambient air enters the nozzle. Further, it is better to slightly increase internal pressure of the container body in order to enhance curvature of the nozzle by depressing the container body 2, as shown in FIG. 4(*b*).

Figure 5A:
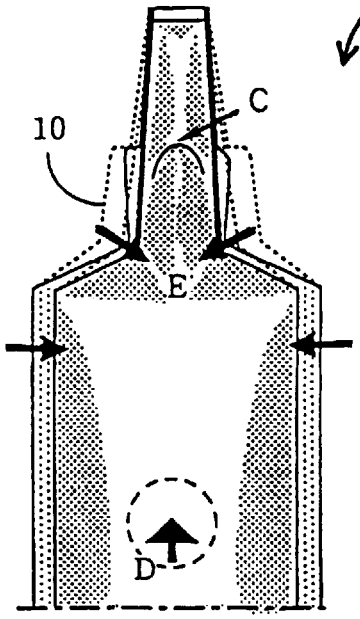
FIGS. 5(*a*)–5(*c*) are views for explaining effects of the nozzle of the present invention.
Figure 5B:
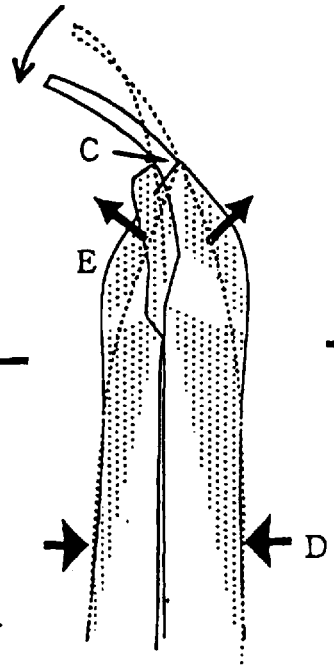
Figure 5C:
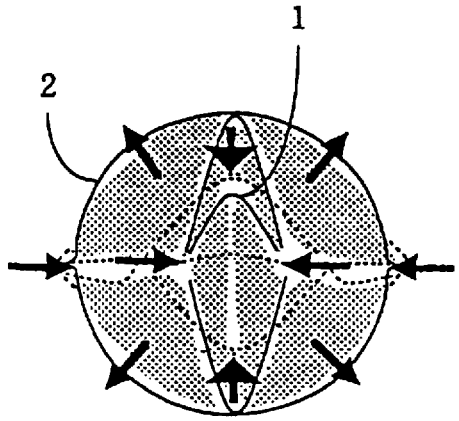

It is noted that, as shown in FIGS. 6(*a*) and 6(*b*), a welding width 9 is larger in an upstream part of the nozzle than in a downstream part (tip end side) of the nozzle, and accordingly, deformation of a container edge part 10 extending toward part E shown in FIG. 5*a* becomes greater by enhancing rigidity of that edge part to intensify a force exerted to point C so as to enhance its curvature while deformation of the nozzle 1 caused by depressing point E, in order to discharge contents, becomes smooth so as to allow discharge of the contents to be easier.

Further, after the two flexible sheets 5 constituting the nozzle 1 are welded, widthwise opposite ends are again welded, as shown in FIG. 3(*c*), by a clamping force which is greater than an initial force so that rigidity of the nozzle 1 is enhanced in its entirety, and accordingly, discharge of contents from the nozzle becomes easier and functional.

Figures 8A, 8B, 8C, 8D, 8E:
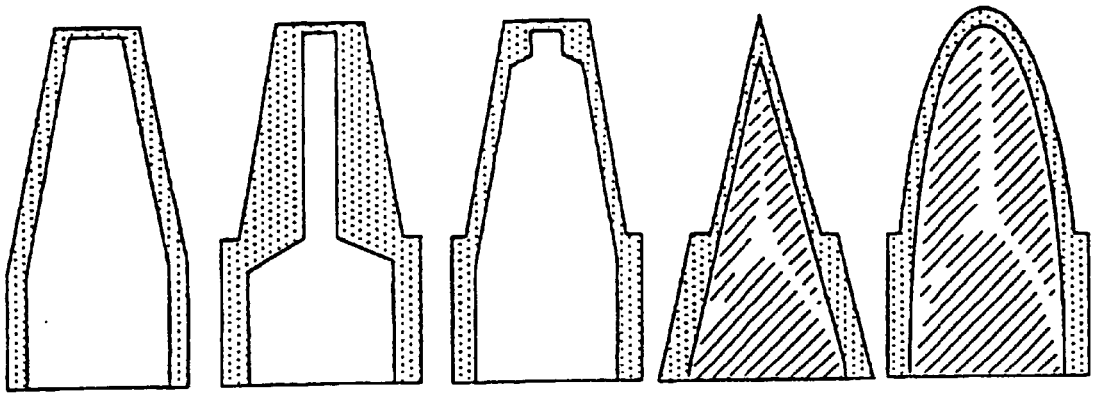
FIGS. 8(*a*)–8(*e*) are views for explaining variation of a shape of the nozzle of the present invention.

FIGS. 8(*a*) to 8(*e*) show variations of the nozzle 1 for a fluid container according to the present invention.

FIG. 8(*a*) shows a variation in which a welding width is constant throughout the nozzle 1.

Figure 9A:
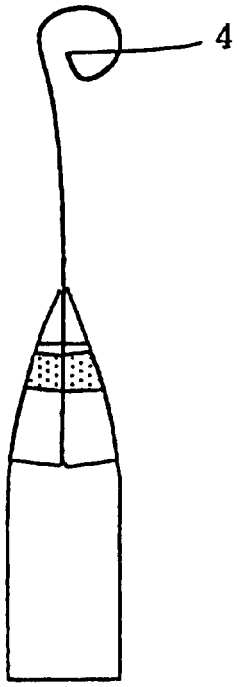
FIGS. 9(*a*)–9(*c*) are views for explaining a shape of a tip of the nozzle of the present invention.
Figure 9B:
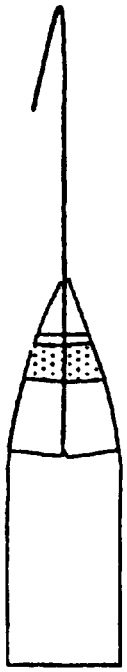
Figure 9C:
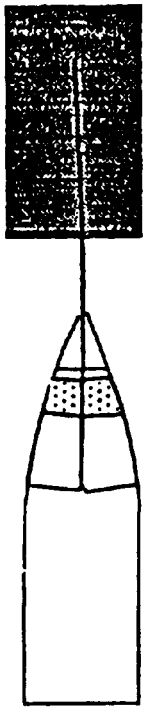

FIGS. 9(*a*)–9(*c*) and 10(*a*)–10(*c*), show variations in which a fluid nozzle is curved. Referring to FIG. 9(*a*) the tip end 4 is rolled, while referring to FIG. 9(*b*) a tip end is substantially bifolded, and referring to FIG. 9*c* a nozzle is clamped in order to completely close the nozzle. Further, referring to FIG. 10(*a*) a nozzle is curved only in a widthwise direction thereof, and referring to FIG. 10(*b*) a nozzle is curved in a direction of a passage in the nozzle.

Figure 11A:
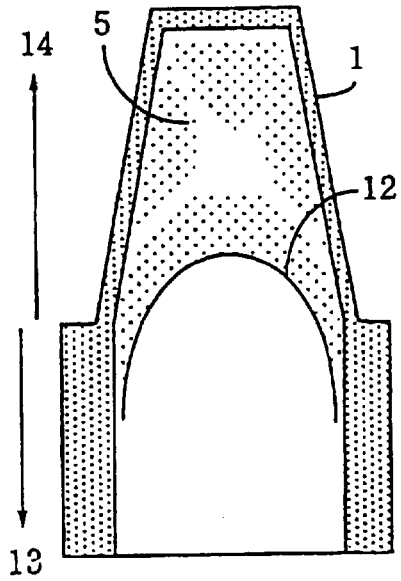
FIGS. 11(*a*) and 11(*b*) are views for explaining a shape of the nozzle of the present invention.
Figure 11B:
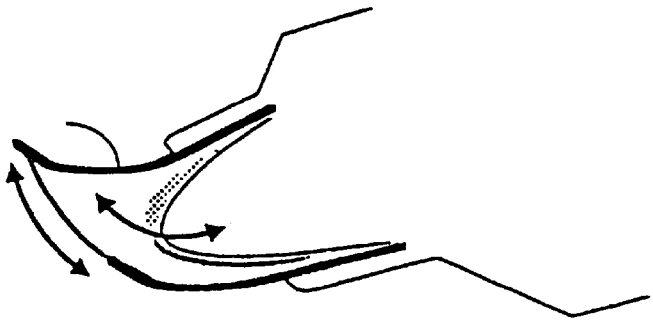

Further, a shape of a nozzle is contrivable as follows:

FIGS. 11*a* and 11*b* show a case in which a curving line (crease) 12 has been previously formed at a desired position (a substantially central position in this figure). With this arrangement, a curved or bent (i.e. non-planar) condition can be easily maintained even in a normal state. As to a process of forming the curving line 12, there may preferably be used a press method (a so-called press line, that is, hot-pressing or cold pressing). Thus, the crease or curving line 12 is defined by a plastically deformed portion of one of the flexible sheets.

In addition, it may be considered that thickness and hardness (or flexibility) of flexible sheets 5 are different between parts positioned forwardly and rearwardly from the curving line 12 as a border line. In this case, it may be considered that an upstream side (a container body side) 13 of nozzle 1 is thin or soft while a downstream side (tip end side or close-contact side) 14 of the nozzle is thick or hard.

Figure 12A:
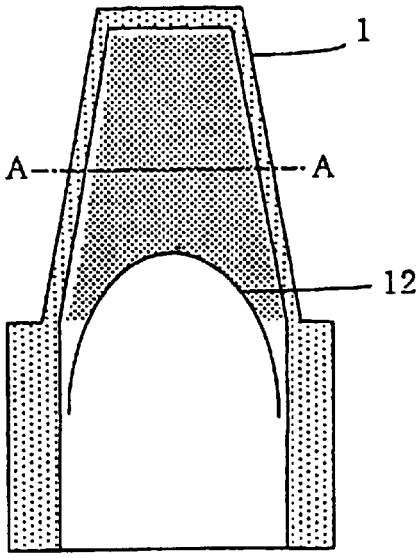
FIGS. 12(*a*) and 12(*b*) are views for explaining a shape of the nozzle of the present invention.
Figure 12B:
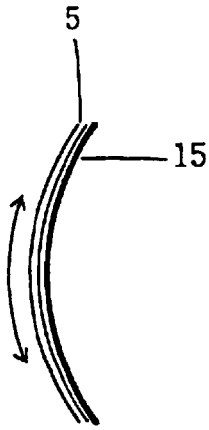

Further, as shown in FIGS. 12(*a*) and 12(*b*), a part positioned forwardly of the curving line 12 is provided therein with an elastic member 15 for forcing the nozzle to curve or bend inwardly in a tip end part in order that the flexible sheets 5 constituting the nozzle 1 are extended while they come into close contact with each other. In this case, as to the elastic member 15, a Belleville spring is most preferable. However, the elastic member is not limited to this spring together with material thereof so long as the elastic member biases the nozzle into a non-planar configuration.

Figure 13A:
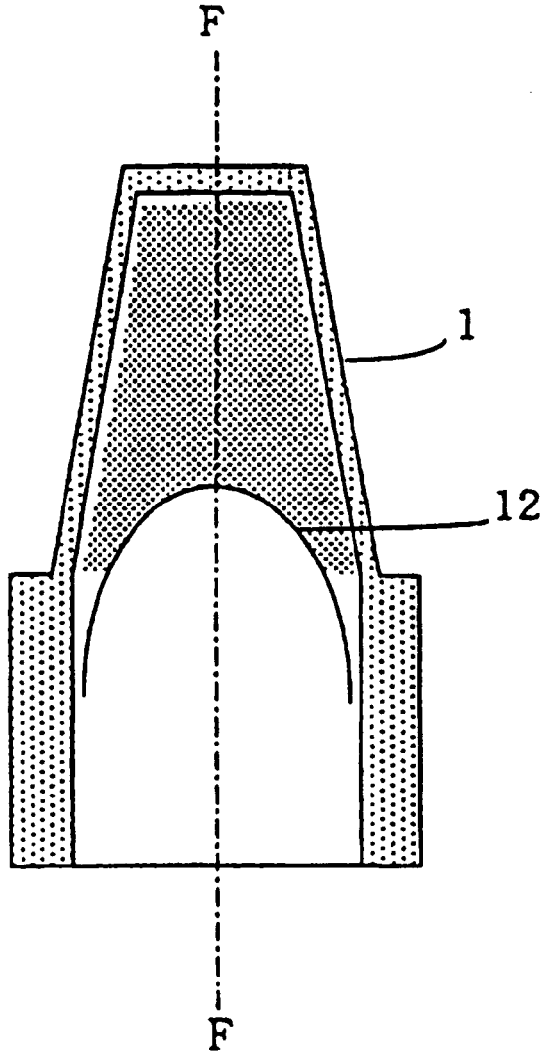
FIGS. 13(*a*) and 13(*b*) are views for explaining a shape of the nozzle of the present invention.
Figure 13B:
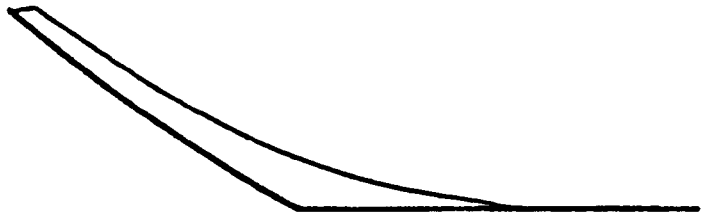

FIG. 13(*a*) shows a case in which nozzle 1 has been previously formed into a dish-like shape, and FIG. 13(*b*) is a sectional view along line F—F in FIG. 13(*a*). This case may be combined with the case in which hardness and thickness are different between parts positioned forwardly and rearwardly of the curving line 12 as a border line, as mentioned above. This can enhance a degree of adhesion between flexible sheets 5 at the curving line 12, more than when the nozzle merely exhibits a spoon-like shape, whereby it is possible to enhance reliability of the nozzle.

Figure 14A:
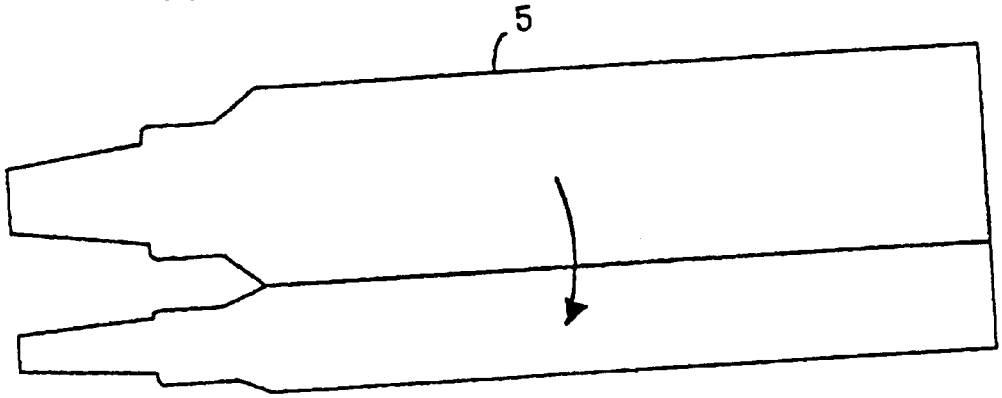
FIGS. 14(*a*)–14(*c*) are views for explaining a method of forming the nozzle and the container body.
Figure 14B:
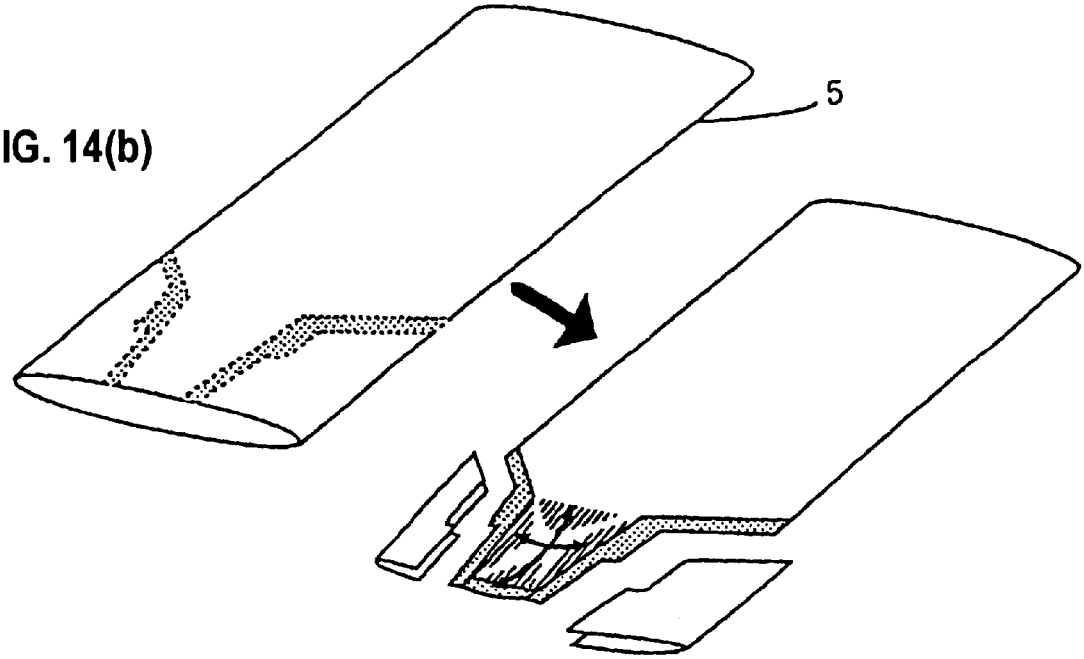
Figure 14C:
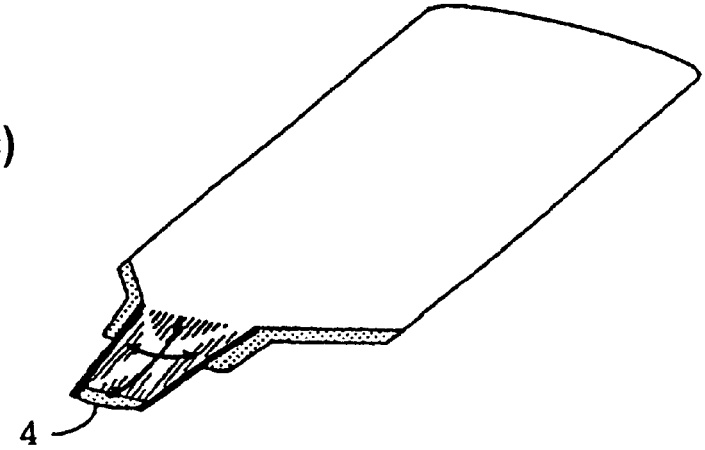

FIGS. 14(*a*) to 14(*c*) show another method of forming a fluid container incorporating the nozzle according to the present invention.

Although two separate flexible sheets 5 are superposed with each other in the method shown in FIGS. 3(*a*) to 3(*d*), container body 2 may be formed by a single flexible sheet 5 which is bifolded as shown in FIG. 14(*a*), or container body 2 may be formed by using a flexible sheet 5 which is originally tubular, as shown in FIG. 14(*b*). FIG. 14(*c*) is a view which shows a completed container. This method has such an advantage in that a number of welded parts is less than that in the method shown in FIG. 3.

It is noted that welding of tip end 4 of the nozzle is not always necessary, but welding may be performed as necessary in view of a kind of contents.

In all embodiments of the present invention, as to material of flexible sheet(s) 5 used for nozzle 1 and container body 2, a flexible composite sheet made of synthetic resin is preferably used. Specifically, polyethylene (PE), polypropylene (PP), nylon or the like is preferable. Further, the sheet(s) to be used preferably has a so-called high barrier property so as to be excellent in terms of being moisture proof and impermeable to air or gas.

Figure 15A:
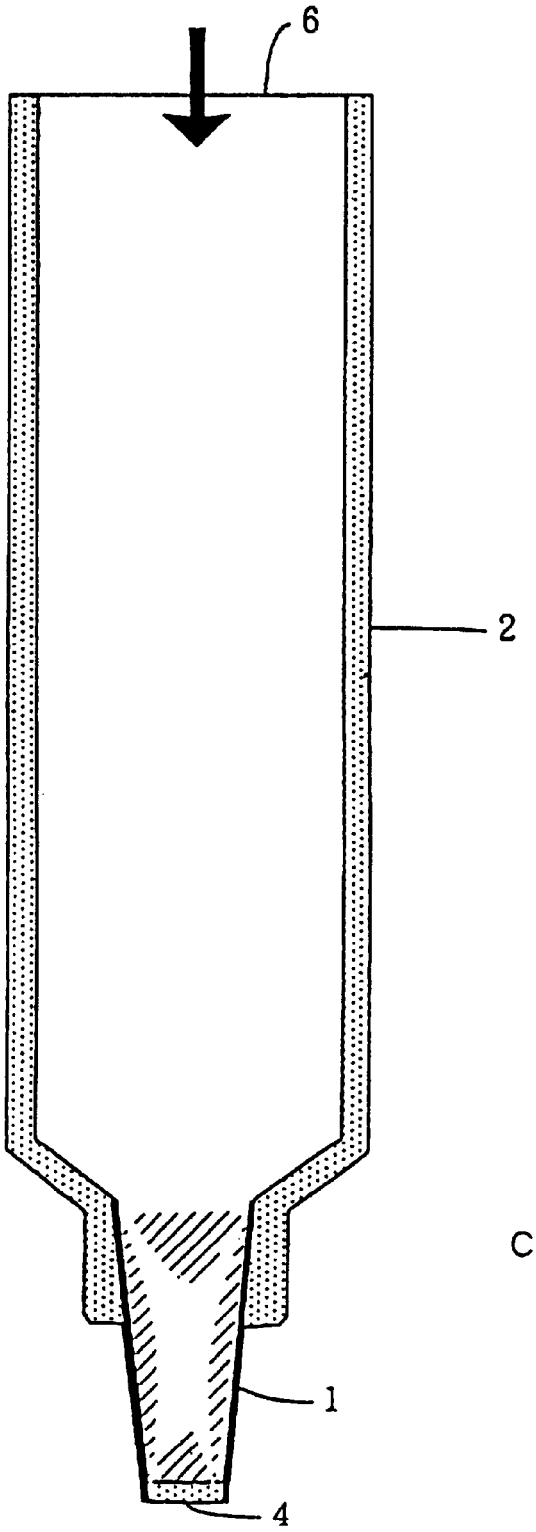
FIGS. 15(*a*) and 15(*b*) are views for explaining a charging method.
Figure 15B:
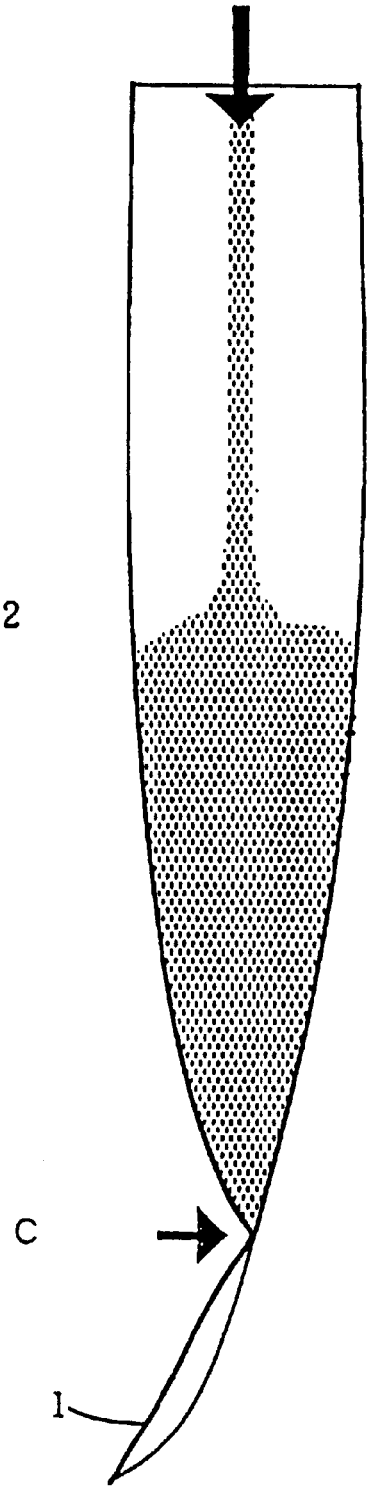

As mentioned above, a nozzle, such as a filler which is not shown is inserted into container body 2 configured as mentioned above, through bottom opening 6 which has not yet been welded so as to fill contents, into the container body as shown in FIGS. 15(*a*) and 15(*b*), and thereafter, the bottom opening 6 is welded shut.

The nozzle 1 according to the present invention allows contents to be filled while the contents are prevented from leaking from the nozzle even though the contents are a low viscous fluid such as water. In order to completely prevent leakage, in view of leakage due to capillary action, nozzle tip end 4 may be welded or it may be clamped by a clamping member.

It is noted that since a curve is formed in the nozzle, contents can be prevented from being accidentally discharged from the nozzle even though a pressure which is generally high is exerted to the container body 2. Further, the greater a pressing of the container for discharging contents, the greater a curvature of the nozzle, in view of a certain kind of contents, whereby the contents can hardly be discharged.

Figure 16:
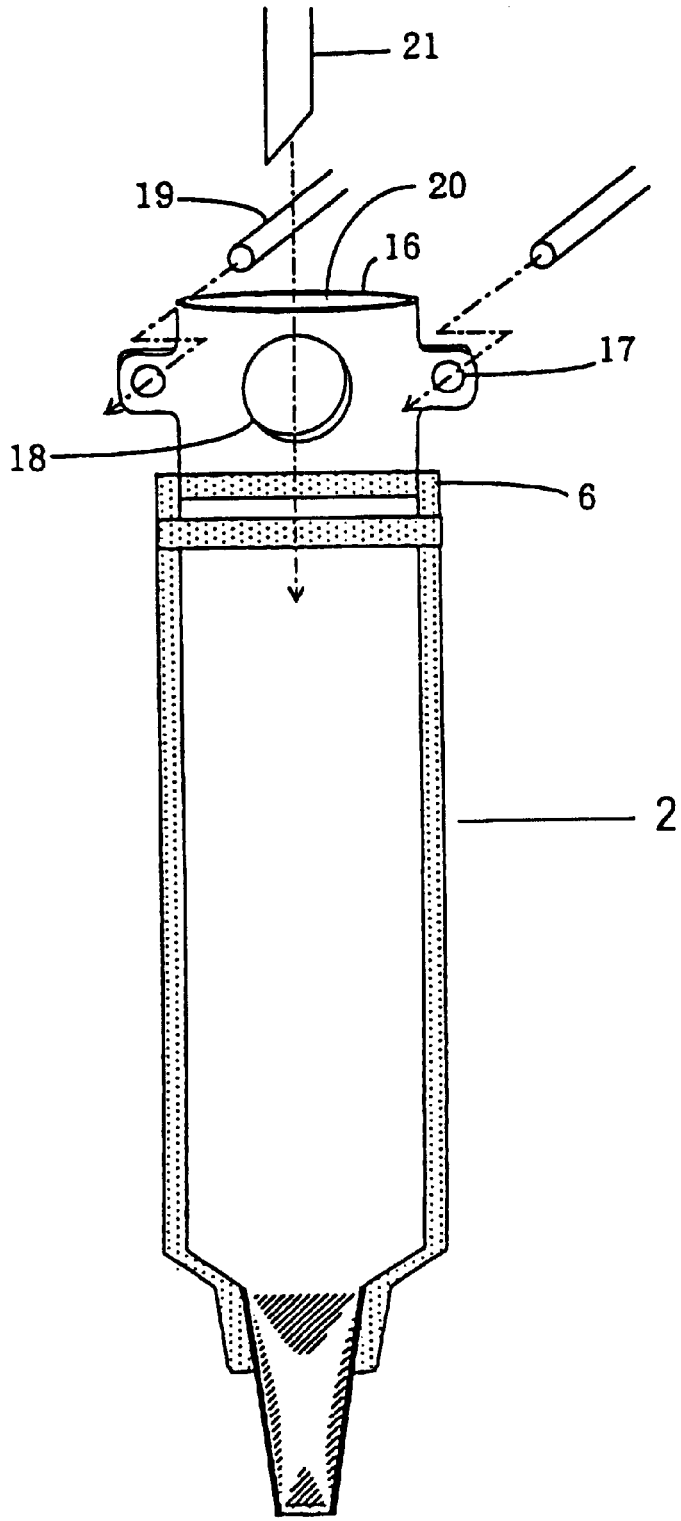
FIG. 16 is a view for explaining a charging method.

FIG. 16 is a front view which shows a third embodiment of the present invention.

In this embodiment, a hanging part 16 is incorporated with the bottom part 6 of container body 2 in order to enhance efficiency of filling of contents, as mentioned above.

The hanging part 16 is provided with hanging holes 17 for filling the container body 2, and a hanging hole 18 for displaying a filled container body as a commodity. Hanging part 16 may have previously been integrally incorporated with sheet 5 of the container body, or hanging part 16 which has been separately prepared may be incorporated with the bottom part 6 of the container body by virtue of welding or the like.

With this arrangement, when contents are filled, as shown in this figure, the hanging holes 17 are inserted onto hangers 19, and thereafter, the hangers 19 are moved toward each other so as to open a filling port 20. Filling nozzle 21 is inserted into the filling port 20 for filling contents into the container body 2. Further, after filling, the bottom part 6 is thermally welded.

Figure 17:
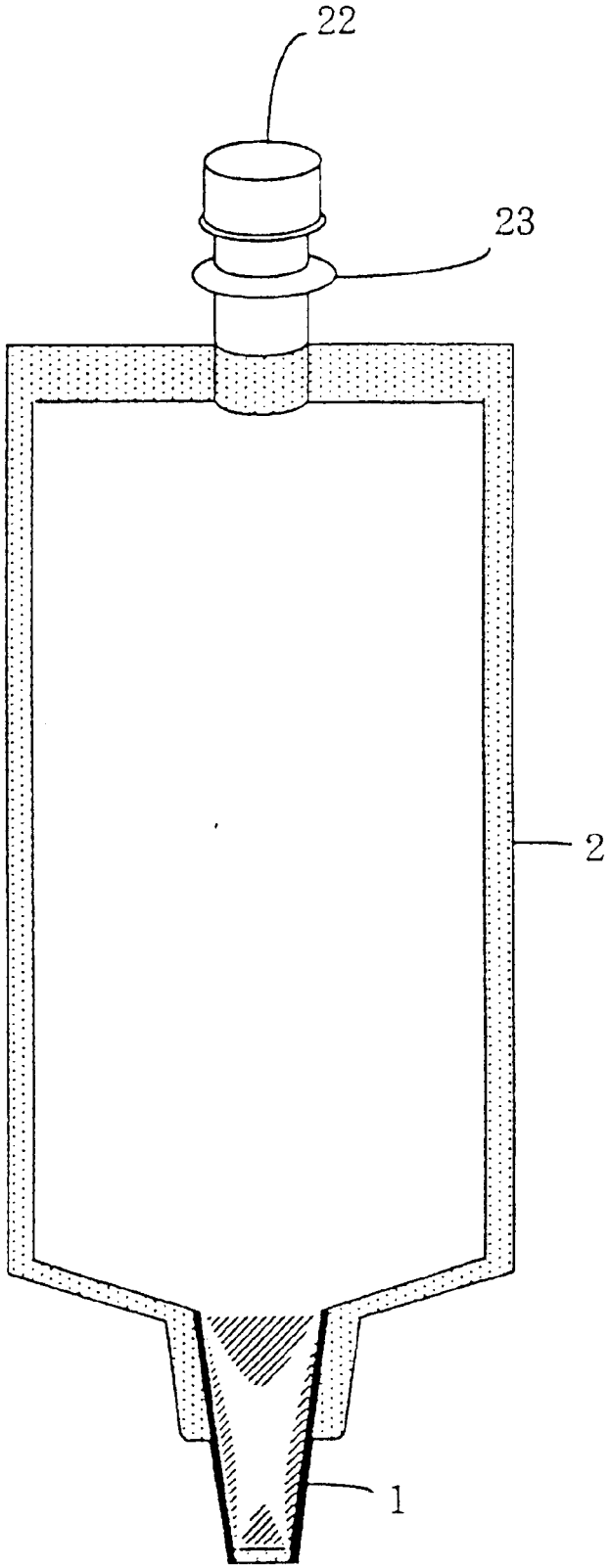
FIG. 17 is a view for explaining an example of a configuration of the container.

FIG. 17 shows a fourth embodiment.

As shown in this figure, container body 2 is formed with a filling port 23 therein, which filling port incorporates a screw cap 22 or the like, and accordingly, the container body 2 can be used repeatedly. Further the container body may be used as a container having a large volume.

Figure 18:
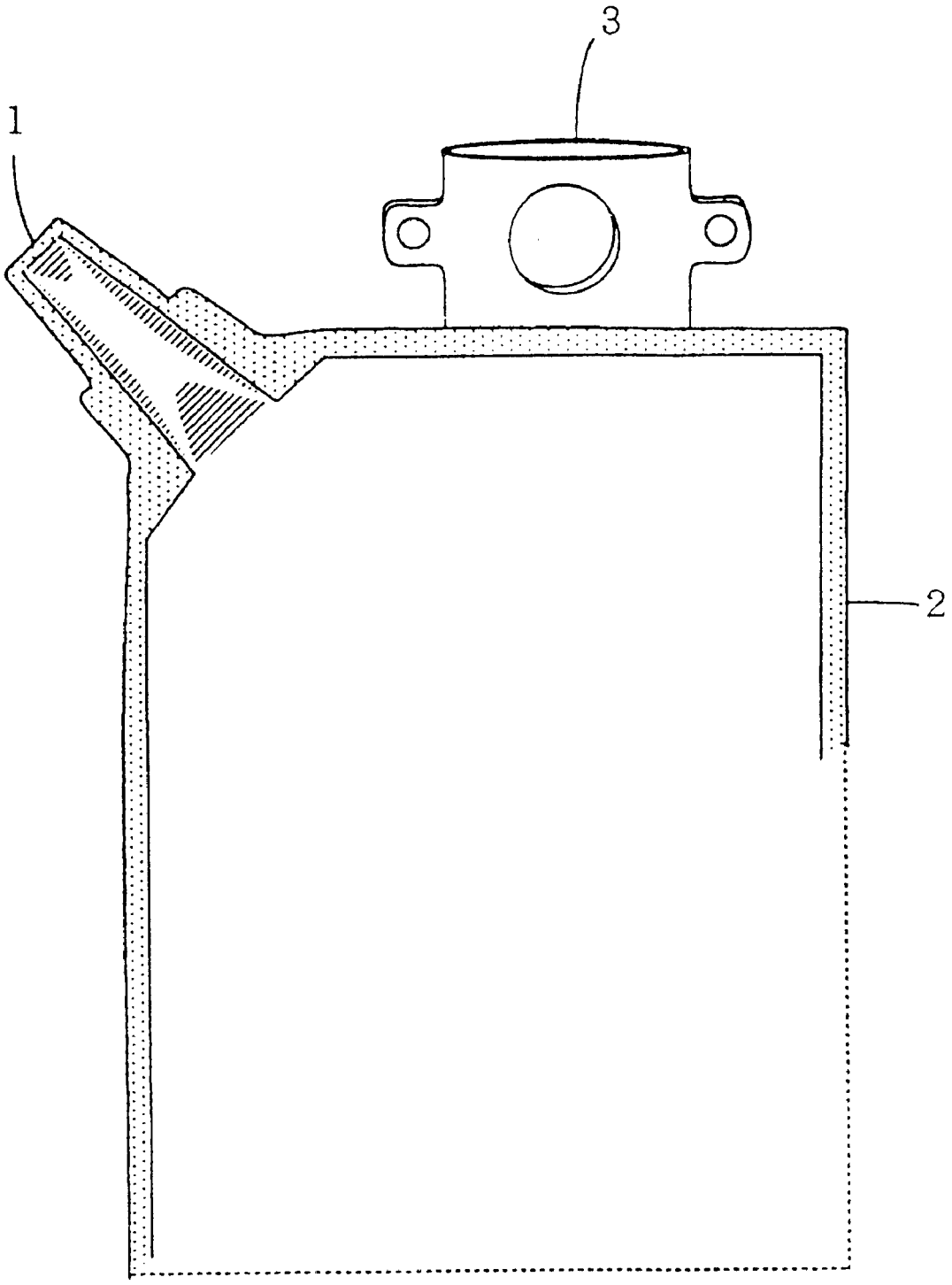
FIG. 18 is a view for explaining an example of a configuration of the container.

FIG. 18 is a front view which shows a fifth embodiment.

In this embodiment, a pot-type container body is used, which is incorporated with filling port 3 and nozzle 1, which are located at the top part of the container body 2 and which are directed upwardly.

Figure 19:
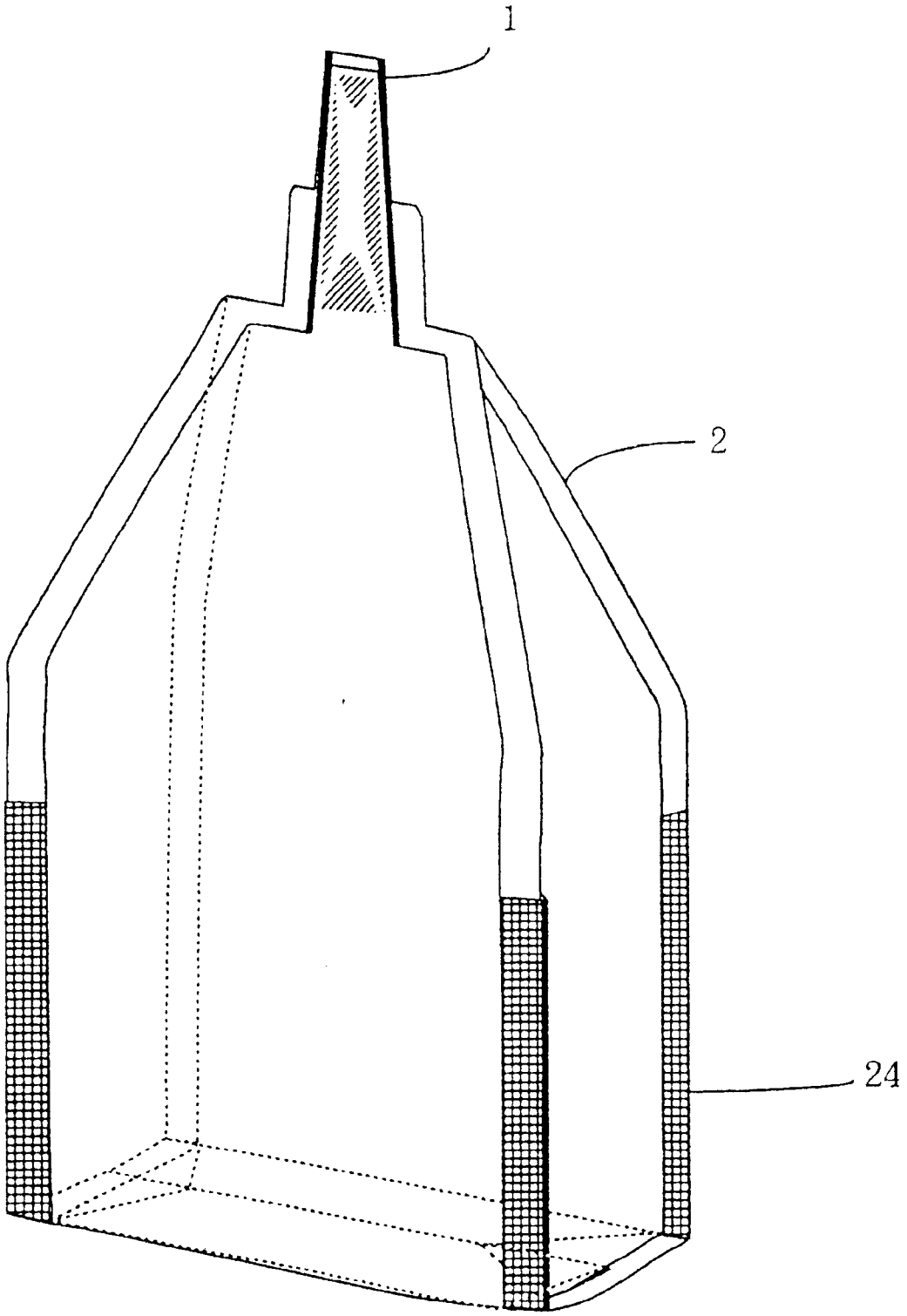
FIG. 19 is a view for explaining an example of a configuration of the container.

FIG. 19 shows a sixth embodiment.

Is noted that a gusset bag is used as container body 2 in this embodiment.

Further, in a case of a large-sized gusset bag, reinforcements 24 may be provided in welded vertical side parts in order to prevent the container body from falling down.

Figures 20A, 20B:
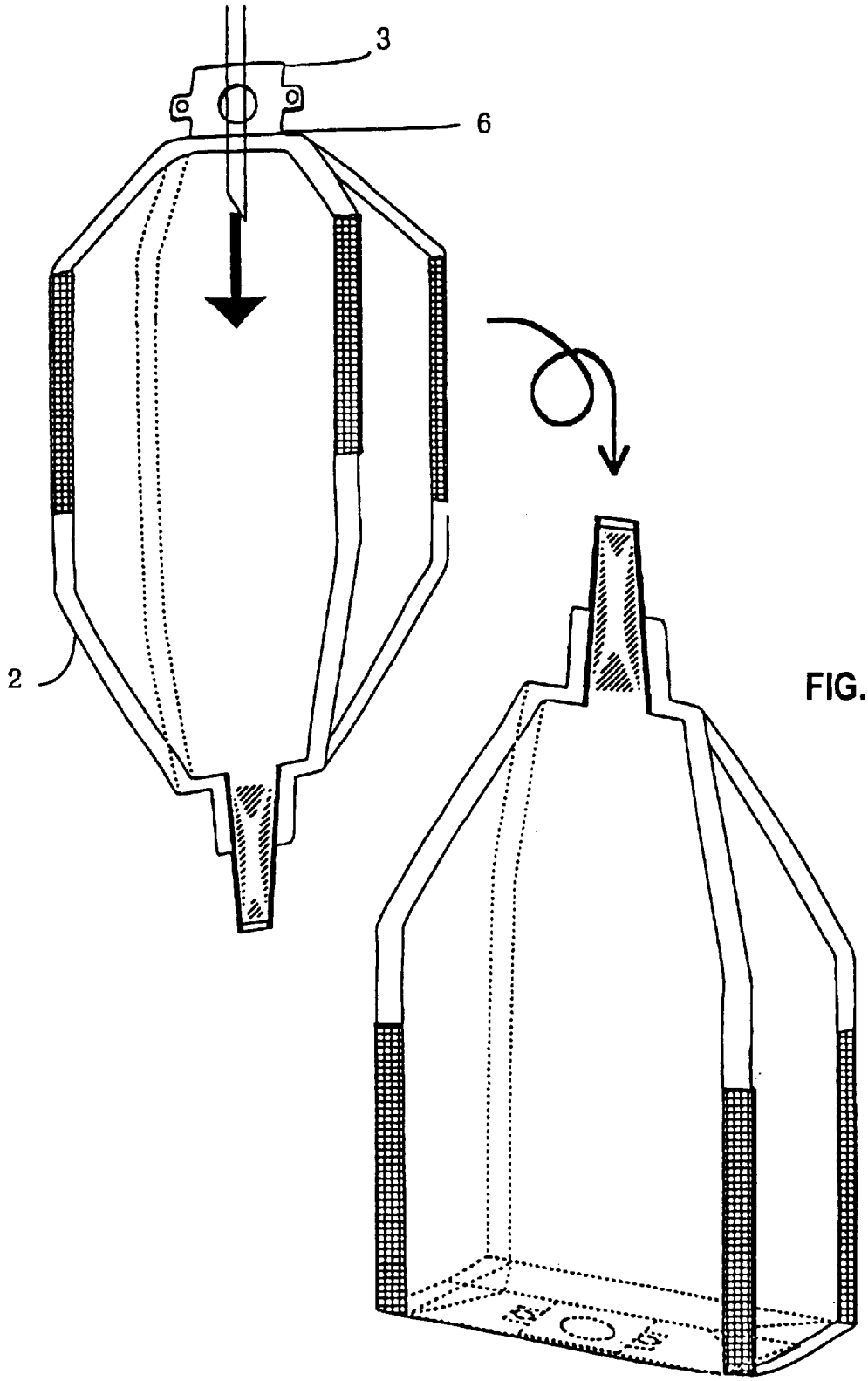
FIGS. 20(*a*) and 20(*b*) are views for explaining an example of a configuration of the container.

FIGS. 20(*a*) and 20(*b*) show a variant form of the embodiment shown in FIG. 19, in which bottom part 6 is formed therein with filling port 3.

Figure 21A:
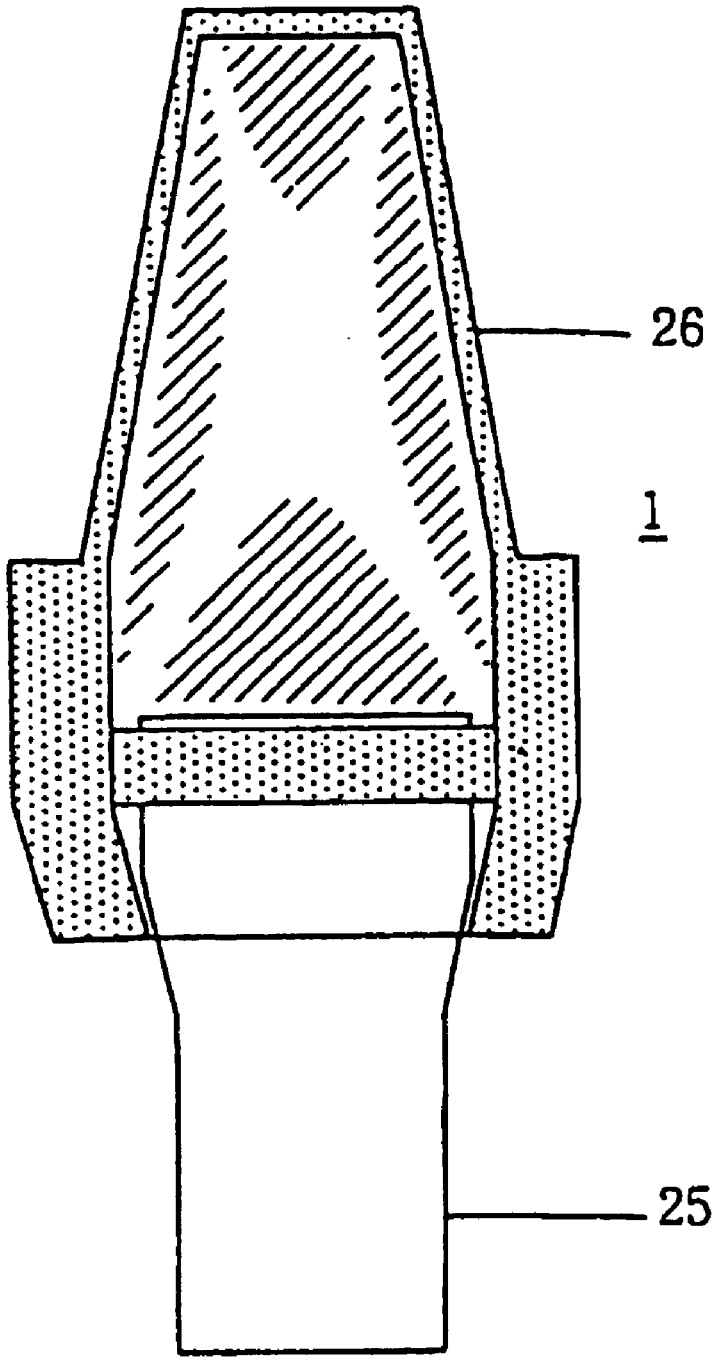
FIGS. 21(*a*) and 21(*b*) are views for explaining another example of configuration of the container.
Figure 21B:
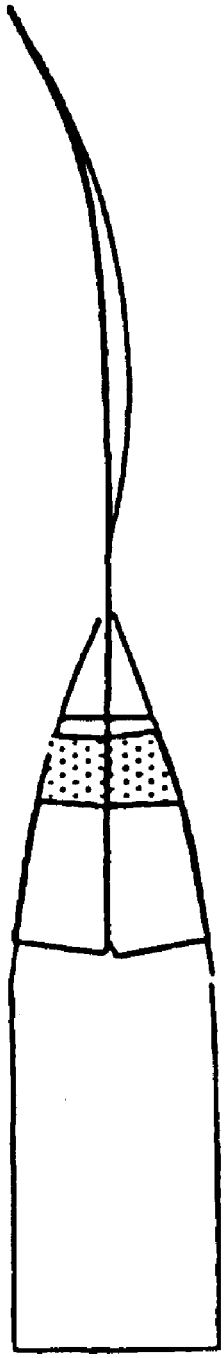
Figure 22A:
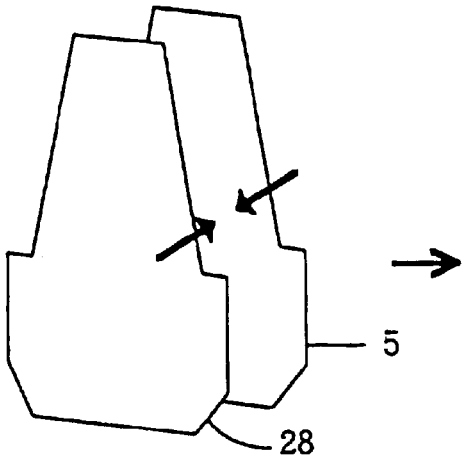
FIGS. 22(*a*)–22(*d*) are views for explaining a forming method of the nozzle of the present invention.
Figure 22B:
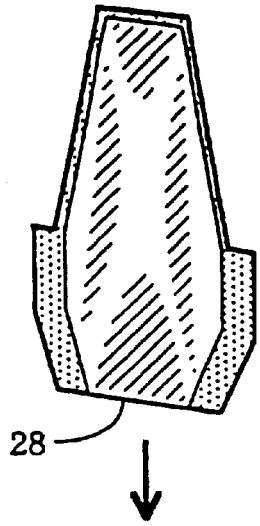
Figure 22C:
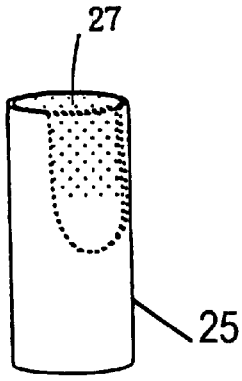
Figure 22D:
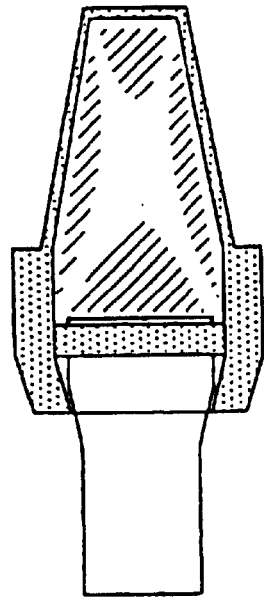

FIGS. 21(*a*) to 27(*c*) show other embodiments of nozzle 1 according to the present invention. Although the nozzle which has been explained hereinabove is integrally incorporated with a container body, these embodiments are of a general purpose type, and accordingly, the nozzle thereof may be substituted for a cap of an existing container.

Referring to FIGS. 21(*a*) and 21(*b*), nozzle 1 is composed of a tubular part 25 and a close contact part 26. FIG. 21(*a*) is a front view of the nozzle while FIG. 21(*b*) is a side view of the nozzle.

This nozzle 1 is configured as shown in FIG. 22(*a*) to 22(*d*). That is, as shown in FIG. 22(*a*), two flexible sheets 5 which have been cut into a desired shape for preparation, are superposed with each other, and are then thermally welded at their peripheries, except for lower side parts of the sheets as shown in FIG. 22(*b*). In this case, the two flexible sheets are not always essential, and a single flexible sheet, which is bifolded along one side and then thermally welded along its periphery, may also be used so as to form the nozzle.

Referring to FIG. 22(*c*), which shows a tubular member 25 as an upstream part, an inner surface of the tubular member 25 is subjected to a non-thermal welding process 27 which is desirable for satin-finishing the inner surface. That is, with this satin-finishing process, micro-unevenness is formed on the inner surface so that heat-transmission is extremely lowered, and accordingly, a surface to come into contact is prevented from being fused (can hardly be fused). It is noted that there may be used another method in which a sheet made of a material which is different from material of the tubular member 25, and which is not thermally welded, may be held in a hollow part.

Next, the above-mentioned tubular member 25 is inserted into an opening part 28 of a downstream part 26 which has been previously prepared, and both are then thermally welded to each other at their parts to be welded.

As to materials, the upstream part 25 is made of polyethylene (PE) or polypropylene (PP), and the downstream part 26 is preferably formed of a flexible composite sheet made of synthetic resin which is specifically and preferably polyethylene (PE), polypropylene (PP), nylon or the like. Further, the sheets 5 to be used preferably have a so-called barrier property which is excellent in terms of being waterproof and impermeable to air or gas.

Figure 10A:
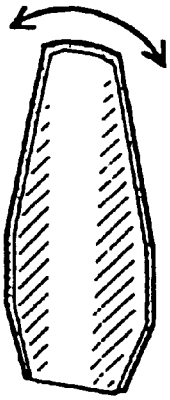
FIGS. 10(*a*)–10(*c*) are views for explaining a curving direction of the nozzle of the present invention.
Figure 10B:
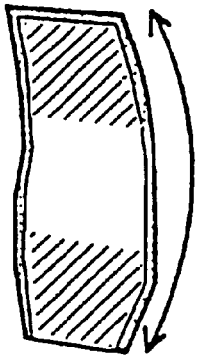
Figure 10C:
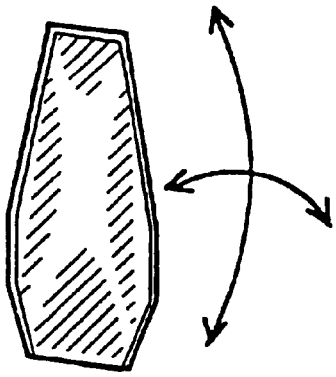

It is important that when the downstream part 26 is welded, a thickness of the sheets to be welded, or a tension thereof, during welding is suitably adjusted so as to curve the downstream part 26 in order to obtain a high degree of adhesion between the sheets 5 after welding. Further, as to a curving direction, there may be considered a direction (trough-like shape) orthogonal to a flowing direction as shown in FIG. 10(*a*), a flowing direction (arcuate shape) shown in FIG. 10(*b*), or a spherical surface shape as shown in FIG. 10(*c*). However, since the spherical surface shape such as a spoon-like shape can be easily manufactured, and since a degree adhesion between superposed sheets 5 becomes higher for this shape, it is possible to surely prevent leakage.

As mentioned above, there may be considered various methods to cause tensions of two sheets to be different from each other in order to allow one of the sheets to shrink, or to press the sheets at such a temperature that the sheets are not welded to each other.

Figure 23A:
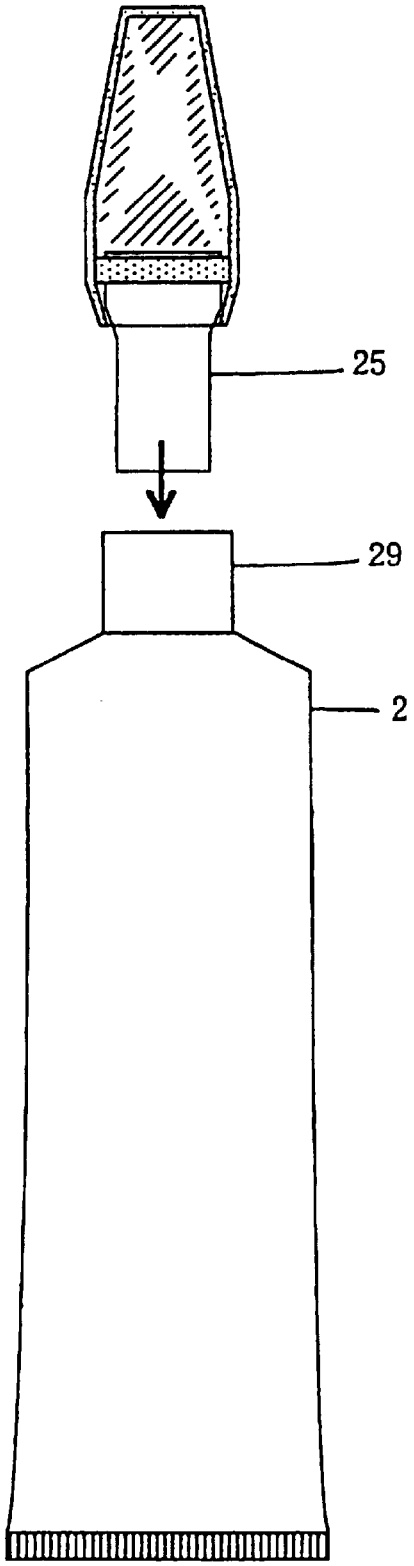
FIGS. 23(*a*) and 23(*b*) are views for explaining an example of attachment of the nozzle of the present invention.
Figure 23B:
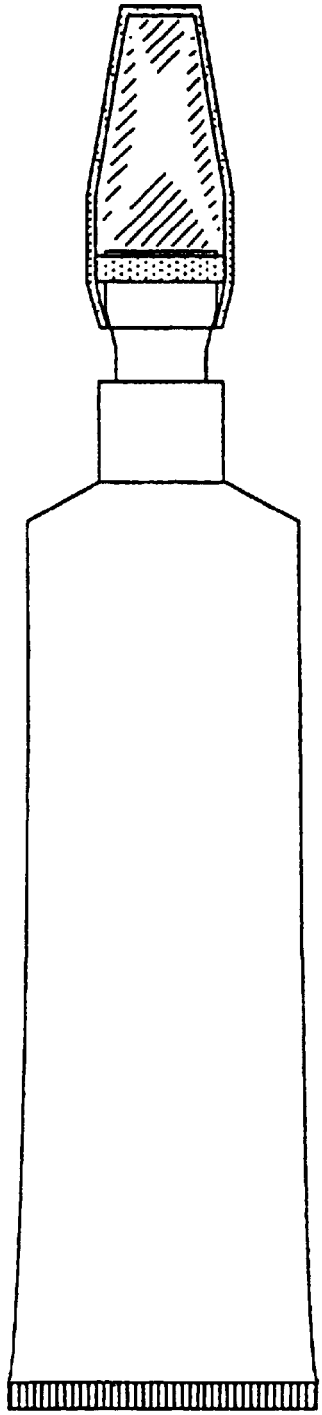

During use of nozzle 1 for container according to the present invention, which is configured as mentioned above, as shown in FIGS. 23(*a*) and 23(*b*), the tubular member or upstream part 25 may be fitted into a discharge port 29 of container body 2. There may be used, as the container body 2, a bag-like container body such as a stand pouch, in addition to a tubular container body as shown in FIGS. 23(*a*) and 23(*b*), which is made of a flexible material. Material and shape of the container body is not so specifically limited.

Figure 24A:
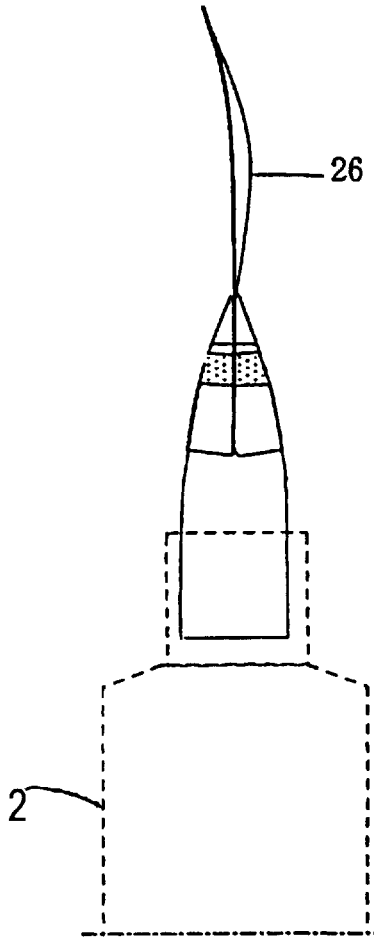
FIGS. 24(*a*)–24(*c*) are views for explaining a using method.
Figure 24B:
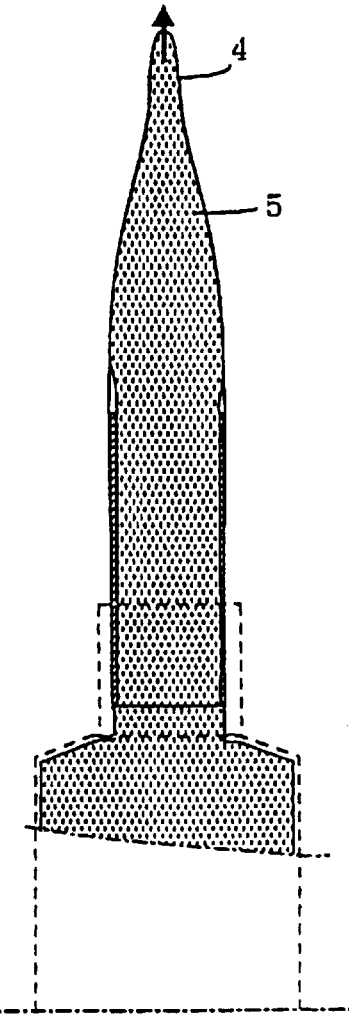
Figure 24C:
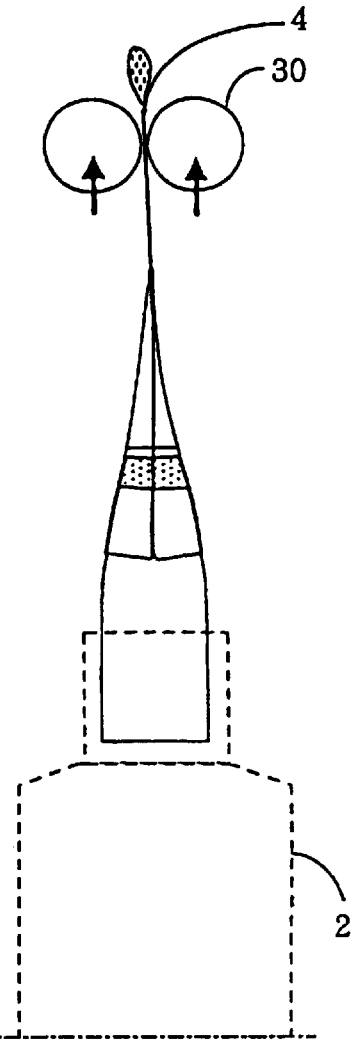

Further, a welded part of nozzle tip end 4 is cut off by scissors or the like so as to open the nozzle tip end 4. Referring to FIGS. 24(*a*) to 24(*c*), in a normal state shown in FIG. 24(*a*) when the contents are to be discharged by depressing container body 2, the contents forces two superposed sheets 5 of downstream part 26 to separate from each other so that contents are discharged from the tip end 4 as shown in FIG. 24(*b*). Finally, the downstream part 26 is squeezed by a spatula, rollers 30 or the like so that contents are pushed out from between the sheets 5, and as a result, the two sheets 5 of the downstream part 26 again come into close contact with each other in a widthwise direction (trough-like shape) thereof, a flowing direction (arcuated shape) or in a spherical surface shape, as shown in FIGS. 10(*a*) to 10(*c*). In this case, the spherical shape can surely prevent leakage since degree of adhesion between the superposed sheets 5 becomes higher, as mentioned above.

It is noted here that as to shape of the downstream part, any of those shown in FIGS. 8(*a*) to 8(*e*) may be used.

Further, the downstream part 26 may not only be curved as mentioned above, but may be curled as shown in FIG. 9(*a*), be bent as shown in FIG. 9(*b*), or be clamped at its tip end by a clamping device as shown in FIG. 9(*c*).

Figure 25A:
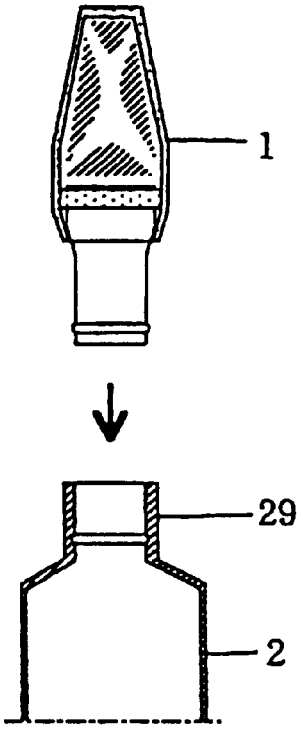
FIGS. 25(*a*)–25(*c*) are views for explaining an attaching method.
Figure 25B:
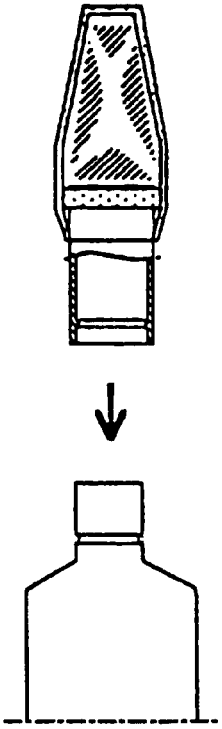
Figure 25C:
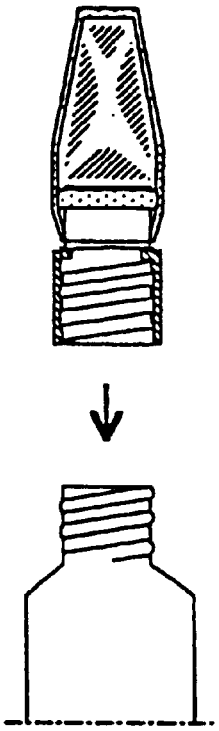

Further, as a method of fitting nozzle 1 to container body 2, there may be used a method of inserting the nozzle 1 into discharge port 29 of the container body as shown in FIG. 25(*a*), a method of inserting the nozzle 1 onto an exterior of the discharge port 29 as shown in FIG. 25(*b*), and a method of screwing the nozzle onto the discharge port as shown in FIG. 25(*c*). Further, the nozzle 1 may be, integrally welded to the container body 2 as in the above-mentioned embodiments.

Figure 26A:
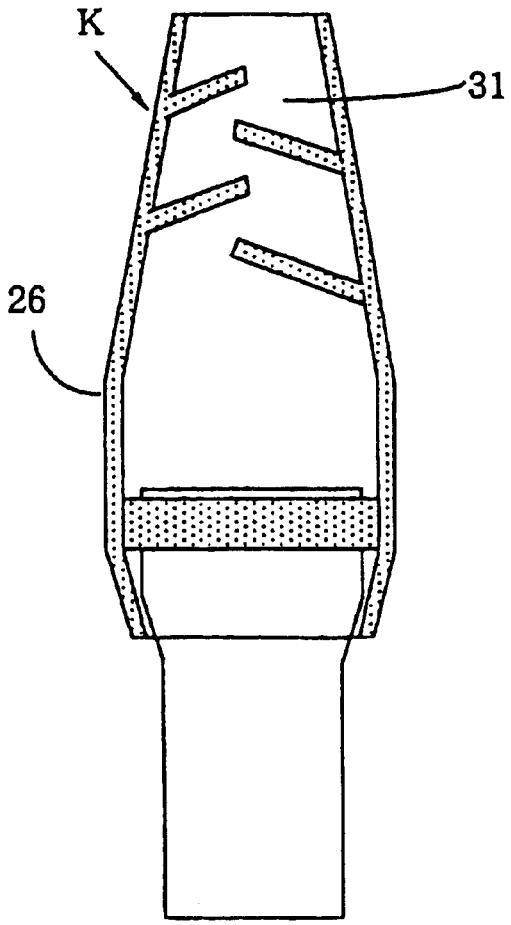
FIGS. 26(*a*) and 26(*b*) are views for explaining an example of a configuration of the nozzle with the container.
Figure 26B:
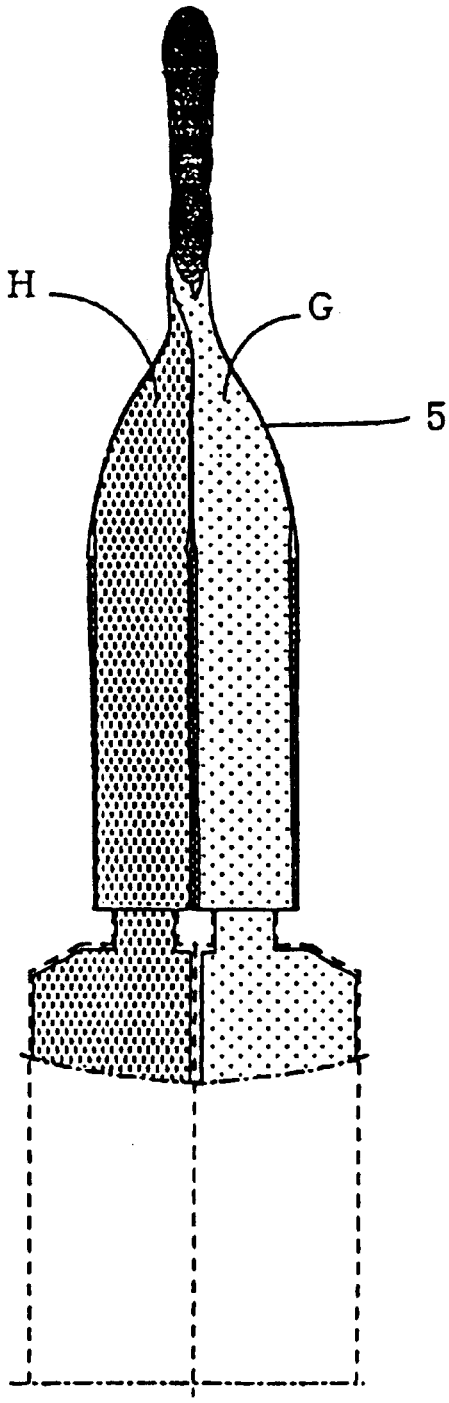

FIGS. 26(*a*) and 26(*b*) are views which show a configuration of another embodiment of the present invention.

In this configuration, three sheets 5 are superposed with one another so as to define two passages G, H. This arrangement is effective for simultaneously discharging two kinds of contents.

In this configuration, if the sheets 5 are formed in a desired shape and arranged parallel to each other, the sheets may be three-folded at their common side, and may then be thermally welded at their peripheries so as to form the same shape as mentioned above. Three superposed sheets are not always essential.

Thus, the two passages are merged in later half K of downstream part 26 into a single passage, and further, the sheets are alternately welded so as to define an agitating passage 31. With this arrangement, a two part adhesive or the like may be discharged in a mixed condition at one time. In this case, if adhesive which is squeezed and mixed in the two merged passages is discharged in its entirety, then it can be prevented from being solidified within the passages.

Figure 27A:
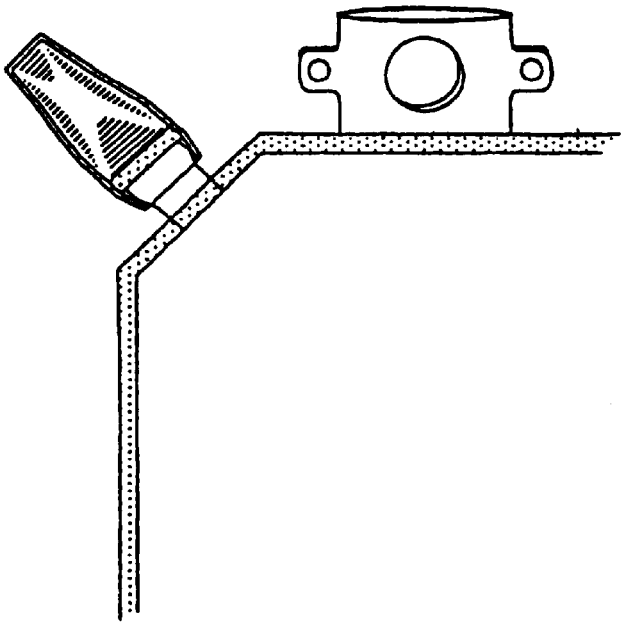
FIGS. 27(*a*)–27(*c*) are views for explaining another example of a configuration of the nozzle with the container.
Figure 27B:
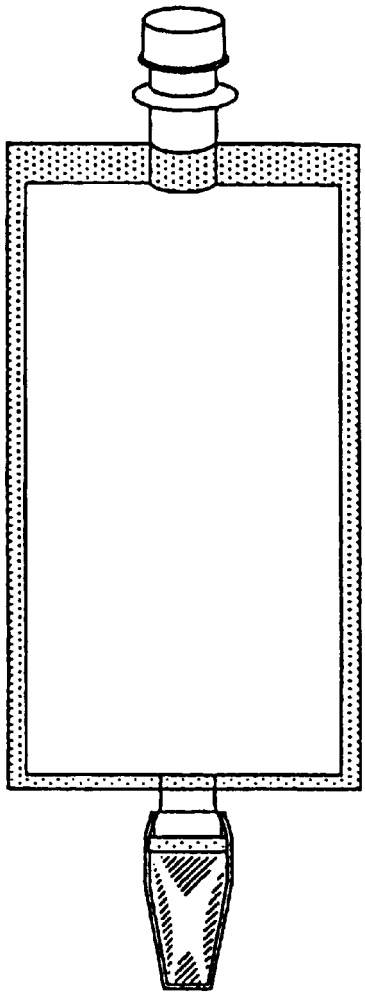
Figure 27C:
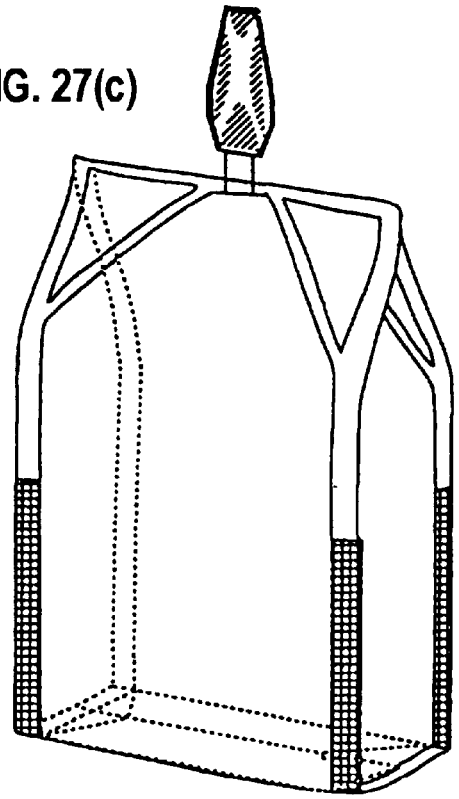

FIGS. 27(*a*) to 27(*c*) show a case that in which a nozzle of this embodiment is applied to a pot-type container body, a filler port incorporating type container body, or a gusset bag type container body.

Figure 28A:
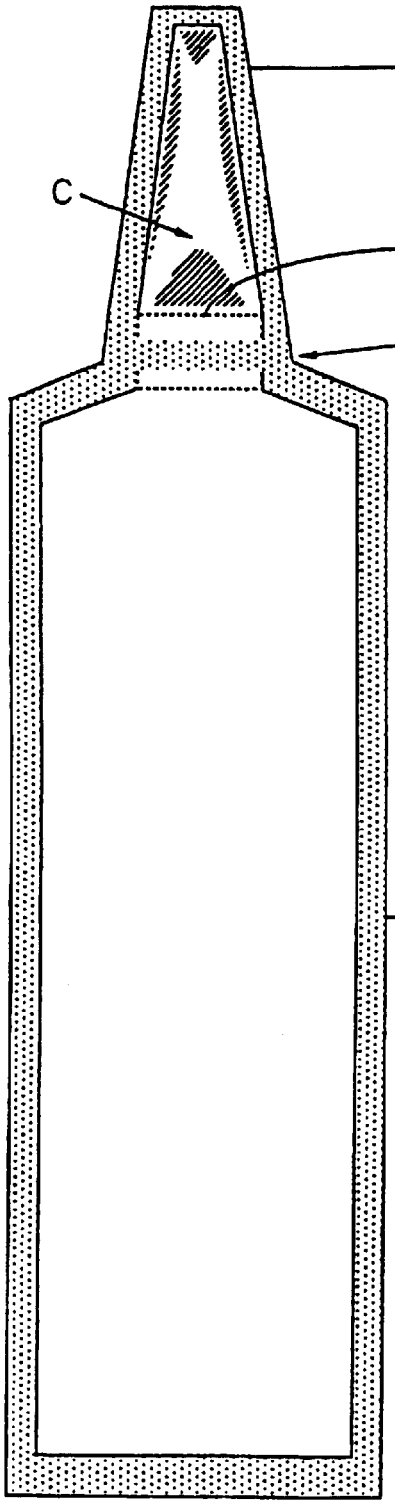
FIGS. 28(*a*) and 28(*b*) are views for explaining another example of a configuration of the nozzle with the container.
Figure 28B:
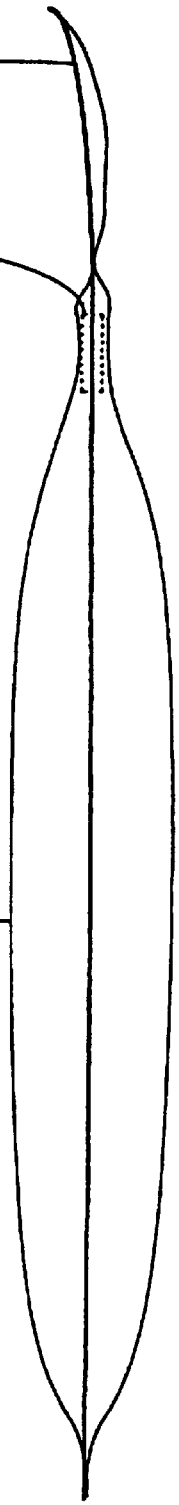

FIGS. 28(*a*) and 28(*b*) shows a seventh embodiment.

Referring to these figures, there is shown a member 32 for preventing flexible sheets from making contact with each other, which member may be a straw-like tubular member that is diametrically depressed or a planar member that is bi-folded. This member 32 serves as a buffer and a guide when contents are pushed out from container body 2.

That is, nozzle 1 at a front end of the container body is in close contact in a normal state so that liquid pushed out from the container body forces the nozzle to open while the liquid advances through the nozzle. However, a joint base part 33 of the nozzle 1 is likely to bend, and accordingly, the liquid itself advances, forcing the nozzle to open while it reforms the nozzle from its bent shape. Thus, resistance becomes excessively high. If curving of this base part is inconvenient, the above-mentioned member 32 is provided so as to previously open the nozzle in order to allow liquid to smoothly advance therethrough.

Thus, the member 32 should not be limited to the tubular member, and may be a planar member if its shape can exhibit the above-mentioned function.

The nozzle 1 or curving of point C can prevent accidental discharge of contents, and accordingly, the member 32 may be incorporated as is necessary in view of a kind of contents. The member 32 severs as a flow rate adjusting mechanism.

The nozzle for a fluid container and fluid container having the nozzle according to the present invention as shown in the respective embodiments can basically be used with no cap, and can prevent contents from leaking due to capillary action even though the contents is a low viscous fluid such as water.

Further, since contents can be prevented from making contact with air even with no cap, a condition of reservation of a material such as an adhesive, which would be deteriorated through reaction with moisture in air, or foodstuffs which would be oxidized, is extremely satisfactory. Further, contents may be smoothly discharged when the container is reused after storage thereof. Further, with no removal of a cap being necessary, the container is convenient.

Further, the nozzle may be optionally combined with any of various bag-like container bodies including a stand pouch container body and a gusset bag container body, in addition to a tubular container body, and accordingly, use of the nozzle can be widespread. Further, by selecting a material adjusted to contents of the container (in particular, a material having a high degree of barrier property is preferable), the nozzle can be used for reservation of liquid in various fields with extreme satisfaction.

INDUSTRIAL USABILITY

Since a nozzle for a container, and a container incorporating the nozzle have been configured as mentioned above, a required volume of contents can be discharged while contents remaining in the container after discharge can be completely prevented from making contact with air.

Thus, even though a condition of reservation of contents is remarkably satisfactory, in comparison with a conventional container, the contents therein cannot be consumed at one time, whereby it is possible to prolong a period of reservation in a useable condition.

What is claimed is:

1. A nozzle to be provided at a head of a fluid container, comprising:

at least two flexible sheets superposed with each other and welded to each other along peripheral portions thereof so as to define a nozzle body having (i) welded portions that have a greater width on an upstream side of said nozzle body than on a downstream side of said nozzle body, and (ii) inner surfaces, defined by respective inner surfaces of said at least two flexible sheets, that are in contact one with another such that after contents are filled into the fluid container said inner surfaces in contact with each other define a seal so as to prevent leakage of the contents from a downstream end of said nozzle body, which seal is designed to be broken upon the contents being forced toward said upstream side of said nozzle body via an internal pressure of the fluid container; and a crease in at least one of said at least two flexible sheets so as to define a boundary line in said at least one of said at least two flexible sheets, wherein at least one of said at least two flexible sheets is non-planar prior to the contents being forced toward said upstream side of said nozzle body so as to further prevent leakage of the contents from said downstream end of said nozzle body, and wherein said at least two flexible sheets have a hardness upstream of said crease that is different than a hardness of said at least two flexible sheets downstream of said crease.

2. The nozzle according to claim 1, wherein said hardness of said at least two flexible sheets upstream of said crease is less than said hardness of said at least two flexible sheets downstream of said crease.

3. A nozzle to be provided at a head of a fluid container, comprising:

at least two flexible sheets superposed with each other and welded to each other along peripheral portions thereof so as to define a nozzle body having (i) welded portions that have a greater width on an upstream side of said nozzle body than on a downstream side of said nozzle body, and (ii) inner surfaces, defined by respective inner surfaces of said at least two flexible sheets, that are in contact one with another such that after contents are filled into the fluid container said inner surfaces in contact with each other define a seal so as to prevent leakage of the contents from a downstream end of said nozzle body, which seal is designed to be broken upon the contents being forced toward said upstream side of said nozzle body via an internal pressure of the fluid container; and a crease in at least one of said at least two flexible sheets so as to define a boundary line in said at least one of said at least two flexible sheets, wherein at least one of said at least two flexible sheets is non-planar prior to the contents being forced toward said upstream side of said nozzle body so as to further prevent leakage of the contents from said downstream end of said nozzle body, and wherein said at least two flexible sheets have a thickness upstream of said crease that is different than a thickness of said at least two flexible sheets downstream of said crease.

4. The nozzle according to claim 3, wherein said thickness of said at least two flexible sheets upstream of said crease is less than said thickness of said at least two flexible sheets downstream of said crease.

5. A nozzle to be provided at a head of a fluid container, comprising:

at least two flexible sheets superposed with each other and welded to each other along peripheral portions thereof so as to define a nozzle body having (i) welded portions that have a greater width on an upstream side of said nozzle body than on a downstream side of said nozzle body, and (ii) inner surfaces, defined by respective inner surfaces of said at least two flexible sheets, that are in contact one with another such that after contents are filled into the fluid container said inner surfaces in contact with each other define a seal so as to prevent leakage of the contents from a downstream end of said nozzle body, which seal is designed to be broken upon the contents being forced toward said upstream side of said nozzle body via an internal pressure of the fluid container, wherein said at least two flexible sheets are welded to each other along peripheral portions thereof by performing a first welding operation that utilizes a first clamping force, and then performing a second welding operation that utilizes a second clamping force that is greater than said first clamping force.

6. The nozzle according to claim 5, wherein at least one of said at least two flexible sheets is non-planar prior to the contents being forced toward said upstream side of said nozzle body so as to further prevent leakage of the contents from said downstream end of said nozzle body.

7. A nozzle to be provided at a head of a fluid container, comprising:

at least two flexible sheets superposed with each other and welded to each other along peripheral portions thereof so as to define a nozzle body having (i) welded portions that have a greater width on an upstream side of said nozzle body than on a downstream side of said nozzle body, and (ii) inner surfaces, defined by respective inner surfaces of said at least two flexible sheets, that are in contact one with another such that after contents are filled into the fluid container said inner surfaces in contact with each other define a seal so as to prevent leakage of the contents from a downstream end of said nozzle body, which seal is designed to be broken upon the contents being forced toward said upstream side of said nozzle body via an internal pressure of the fluid container; and an elastic member to bias at least one of said at least two flexible sheets into a non-planar configuration so as to further prevent leakage of the contents from said downstream end of said nozzle body, with said at least two flexible sheets extending along a rear surface of said elastic member.

8. The nozzle according to claim 7, wherein at least one of said at least two flexible sheets is non-planar prior to the contents being forced toward said upstream side of said nozzle body so as to further prevent leakage of the contents from said downstream end of said nozzle body.

9. The nozzle according to claim 8, further comprising:

a crease in at least one of said at least two flexible sheets so as to define a boundary line in said at least one of said at least two flexible sheets.

10. A nozzle to be provided at a head of a fluid container, comprising:

at least two flexible sheets superposed with each other so as to define a nozzle body having inner surfaces, defined by respective inner surfaces of said at least two flexible sheets, that are in contact one with another such that after contents are filled into the fluid container said inner surfaces in contact with each other define a seal so as to prevent leakage of the contents from a downstream end of said nozzle body, which seal is designed to be broken upon the contents being forced toward an upstream side of said nozzle body via an internal pressure of the fluid container; and a tubular portion, having a prescribed width, at an upstream portion of said nozzle body.

11. The nozzle according to claim 10, wherein said nozzle body is of a first material, said tubular portion is of a second material that is different from said first material, and said nozzle body is coaxially connected to said tubular portion so as to define an integral body.

12. The nozzle according to claim 10, wherein at least one of said at least two flexible sheets is non-planar prior to the contents being forced toward said upstream side of said nozzle body so as to further prevent leakage of the contents from said downstream end of said nozzle body.

13. The nozzle according to claim 12, wherein said nozzle body is of a first material, said tubular portion is of a second material that is different from said first material, and said nozzle body is coaxially connected to said tubular portion so as to define an integral body.

* * * * *